US011391085B2

(12) United States Patent
Powell et al.

(10) Patent No.: US 11,391,085 B2
(45) Date of Patent: Jul. 19, 2022

(54) THRESHOLD SEAL APPARATUS, A KIT OF PARTS AND A METHOD

(71) Applicant: Lorient Polyproducts Ltd, Newton Abbot (GB)

(72) Inventors: Maria Powell, Newton Abbot (GB); Jason Williams, Newton Abbot (GB); Simon Klippel, Harrogate (GB); Kerry Hicks, Newton Abbot (GB)

(73) Assignee: LORIENT POLYPRODUCTS LTD, Newton Abbot (GB)

( * ) Notice: Subject to any disclaimer, the term of this patent is extended or adjusted under 35 U.S.C. 154(b) by 192 days.

(21) Appl. No.: 16/302,101

(22) PCT Filed: May 15, 2017

(86) PCT No.: PCT/EP2017/061621

§ 371 (c)(1),
(2) Date: Nov. 16, 2018

(87) PCT Pub. No.: WO2017/198623

PCT Pub. Date: Nov. 23, 2017

(65) Prior Publication Data

US 2019/0145158 A1 May 16, 2019

(30) Foreign Application Priority Data

May 17, 2016 (GB) ..... 1608678

(51) Int. Cl.

| | |
|---|---|
| ***E06B 7/205*** | (2006.01) |
| ***E06B 7/215*** | (2006.01) |
| ***E06B 1/70*** | (2006.01) |

(52) U.S. Cl.
CPC ..... *E06B 7/205* (2013.01); *E06B 1/70* (2013.01); *E06B 7/215* (2013.01); *E06B 2001/707* (2013.01)

(58) Field of Classification Search
CPC ... E06B 7/20; E06B 7/205; E06B 7/21; E06B 7/215

(Continued)

(56) References Cited

U.S. PATENT DOCUMENTS 56,046 A * 7/1866 Hawkins
448,997 A * 3/1891 Rockwell (Continued)

FOREIGN PATENT DOCUMENTS

CH 556967 A 12/1974
DE 202007011442 U1 12/2008

(Continued)

OTHER PUBLICATIONS

International Search Report in International Application No. PCT/EP2017/061621, dated Aug. 1, 2017, 3pp.

(Continued)

*Primary Examiner* — Gregory J Strimbu
(74) *Attorney, Agent, or Firm* — Hauptman Ham, LLP

(57) ABSTRACT

A threshold seal apparatus for a doorway, the threshold seal apparatus comprising a floor-mountable channel portion, a seal configured to be received within the channel portion, and an actuation mechanism operable to move the seal with respect to the channel portion between a retracted position and an extended position in which the seal is configured to contact the underside of a door mounted within the doorway.

13 Claims, 31 Drawing Sheets

(58) Field of Classification Search
USPC ..... 49/469, 304, 306, 310
See application file for complete search history.

(56) References Cited

U.S. PATENT DOCUMENTS

| | | | | | |
|---|---|---|---|---|---|
| 704,395 | A | * | 7/1902 | Sowden | |
| 991,597 | A | * | 5/1911 | Barber | |
| 1,802,834 | A | * | 4/1931 | Reed | E06B 7/20 49/304 |
| 2,066,188 | A | * | 12/1936 | Reese | E06B 7/20 49/307 |
| 2,579,875 | A | | 12/1951 | Stanko | |
| 2,818,614 | A | | 1/1958 | Lapka, Jr. | |
| 2,829,405 | A | * | 4/1958 | Huff | E06B 7/20 49/304 |
| 4,805,345 | A | * | 2/1989 | Ohi | E06B 7/215 49/308 |
| 6,125,584 | A | * | 10/2000 | Sanders | E06B 7/215 49/310 |

FOREIGN PATENT DOCUMENTS

| | | | | |
|---|---|---|---|---|
| DE | 20 2013 105 930 | | * | 3/2014 |
| EP | 1717405 | A1 | | 11/2006 |
| EP | 2305938 | A1 | | 4/2011 |
| JP | S61-204490 | A | | 9/1986 |
| JP | H11-264282 | A | | 9/1999 |
| JP | 2006-89920 | A | | 4/2006 |

OTHER PUBLICATIONS

Search Report in GB Application No. 1608678.7, dated Nov. 16, 2016, 4pp.
Written Opinion in International Application No. PCT/EP2017/061621, dated Aug. 1, 2017, 11pp.

* cited by examiner

THRESHOLD SEAL APPARATUS, A KIT OF PARTS AND A METHOD

RELATED APPLICATIONS

The present application is a National Phase of International Application Number PCT/EP2017/061621, filed on May 15, 2017, and claims priority to Great Britain application Number 1608678.7, filed on May 17, 2016.

TECHNICAL FIELD

Aspects relate, in general, to a threshold seal apparatus, a kit of parts and a method.

BACKGROUND

Doors are typically installed with a clearance gap between the lower surface of the door and the floor surface or threshold over which the door moves so as to allow free movement of the door over the floor surface. However, in some cases it may be desirable for a door to seal against the floor surface when the door is in its closed position, for example to improve fire resistance, thermal insulation and/or sound proofing.

A seal may be provided between a door and a floor surface by way of a fixed door seal or threshold seal. Such threshold seals have a sealing member which is held in a retracted position within the door whereby to provide a clearance gap over the floor surface when the door is open so as to increase ease of movement of the door and avoid unnecessary wear of the floor surface and the seal. The sealing member can be moved into an extended position in which it contacts the floor surface to form a seal between the door and the floor surface as the door reaches its closed position.

Installation of threshold seals in doors can be problematic and time consuming as a suitable rebate must be prepared in the door to receive the seal and the actuating mechanism. In addition, the mechanism itself takes up some room on at least one side of the door, which means that the threshold seal cannot seal right up to the edge of the door and a suitable seal cannot typically be provided on a door frame that extends down to the bottom of the door.

SUMMARY

According to an example, there is provided a threshold seal apparatus for a doorway, the threshold seal apparatus comprising a floor-mountable channel portion, a seal configured to be received within the channel portion, and an actuation mechanism operable to move the seal with respect to the channel portion between a retracted position and an extended position in which the seal is configured to contact the underside of a door mounted within the doorway.

The actuation mechanism can comprise a slide bar comprising an arm configured to be slideably mounted in the channel portion, the arm further including an elongate opening therethrough and a thumb portion at one end, the thumb portion configured to protrude substantially perpendicularly to a long axis of the arm from an end of the channel portion when the arm is in situ in the channel portion. The arm comprises first and second arm parts separated by a gap, the width of which can be modified using an adjustment control structure. An adjustment arm can be configured to link or otherwise attach the first and second arm parts. The adjustment control structure can be connected with or otherwise attached to the thumb portion. The actuation mechanism can further include a first elongate leaf spring, wherein one end of the first leaf spring is mounted or affixed to the arm and the other end of the first leaf spring is mounted in the elongate opening. The first leaf spring can be mounted in the elongate opening using a first mounting block fixedly attached to the said other end of the first leaf spring, the first mounting block configured to be free to travel in the elongate opening in a direction parallel to the long axis of the arm. A restricting mechanism arranged on or as part of the apparatus can be provided, and which can be configured to limit the movement of the first mounting block within the elongate opening relative to the channel portion in at least one direction as the slide bar is moved relative to the channel portion. The restricting mechanism can comprise a rollpin and/or constriction, constrictions or indentations of the channel portion. That is, the constriction can comprise one or more indentations of the channel portion so configured as to limit movement of the first mounting block within the channel portion in the at least one direction. The first mounting block can comprise a foot configured to engage in the elongate opening. The elongate opening can be longer, in a direction parallel to the long axis of the arm, than the length of the foot whereby to enable the first mounting block to travel within the elongate opening. The first leaf spring can be mounted to the arm using a second mounting block fixedly attached to the said one end, the second mounting block including a foot configured to sit within a corresponding second opening in the arm arranged in spaced relation to the elongate opening. A second elongate leaf spring can be provided, wherein one end of the second leaf spring is mounted or affixed to the arm and the other end of the first leaf spring is mounted in a second elongate opening of the arm. The second leaf spring can be mounted in the second elongate opening using a third mounting block fixedly attached to the said other end of the second leaf spring, the third mounting block configured to be free to travel in the second elongate opening in a direction parallel to the long axis of the arm.

The threshold seal apparatus can further comprise a restricting mechanism arranged on or as part of the apparatus, the restricting mechanism configured to limit the movement of the third mounting block within the second elongate opening relative to the channel portion in at least one direction as the slide bar is moved relative to the channel portion. The second leaf spring can be fixedly attached to a rail portion configured to receive the seal. An interface between the leaf spring or second leaf spring and the rail portion can be provided. The channel portion can comprise a base with a pair of walls depending therefrom, respective ones of the walls including a lip configured to extend substantially perpendicularly from the walls and in an outward direction relative to the channel defined by the base and walls. The channel portion can further comprise a pair of arms disposed within the channel, respective ones of the arms depending from the walls of the channel portion, the arms defining an internal channel configured to accommodate the mounting blocks and the arm. The internal channel can include an opening defined by a pair of lips, the opening so dimensioned as to enable a leaf spring to extend outside of the internal channel. The base can include an indentation configured to receive or accommodate feet of a mounting block. The seal can be a compressible rubber gasket. The seal may include or be composed of an intumescent material. The seal can be biased in the retracted position. The actuation mechanism can be adjustable whereby to enable modification of a maximum or minimum height of the seal when in the extended position. The seal portion can include overlapping flanges whereby to prevent the ingress of deleterious material into the channel portion. The channel portion can include recessed portions configures to receive the flanges of the seal portion when the apparatus is not deployed.

According to an example, there is provided a kit of parts, comprising a threshold seal apparatus as provided here, and a tool for adjusting the threshold seal apparatus.

According to an example, there is provided a method of installing a threshold seal, the method comprising providing a seal apparatus or a kit as provided herein, introducing the channel portion into a suitable recess in the threshold of a doorway in which the apparatus is to be installed, and adjusting the position of a thumb portion of the apparatus whereby to modify the displacement of the actuation mechanism so as to cause the seal to contact the underside of a door mounted within the doorway when the apparatus is actuated.

BRIEF DESCRIPTION OF THE DRAWINGS

Embodiments will now be described, by way of example only, with reference to the accompanying drawings, in which.

DESCRIPTION

Figure 1:
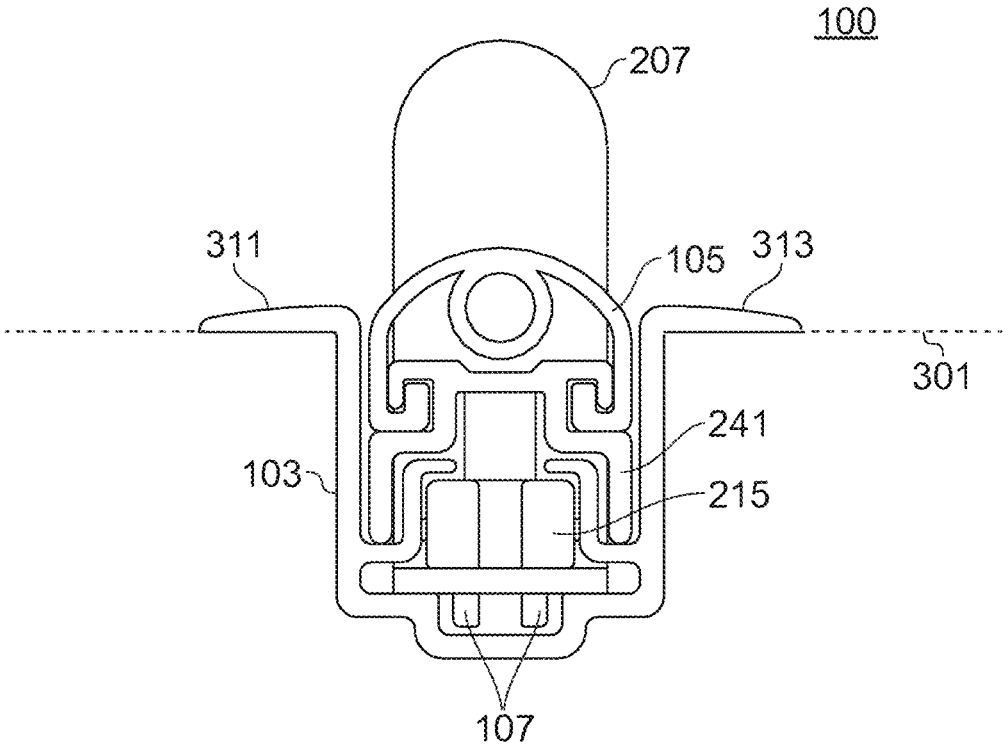
FIG. 1 is a schematic representation of a threshold seal apparatus according to a first example.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Threshold seals in which a sealing member is held in a retracted position within a door are known. As noted above, the sealing member can be moved into an extended position in which it contacts the floor surface to form a seal between the door and the floor surface as the door reaches its closed position. In addition to the problems and inconvenience associated with installation of these threshold seal systems in doors, a further problem exists in relation to the sealing effect of the systems. More particularly, the known systems necessarily include mechanisms to enable a seal to be deployed. The mechanisms typically operate using a device that can be actuated as a door in which a system is fitted is closed thereby causing the seal to be deployed.

The positioning of the mechanism(s) results in regions that are devoid of any sealing effect. For example, a region at either end of the bottom of a door, for example, may not include any seal because of the real estate within the door that would otherwise house the seal being taken up by the deployment mechanism. Similarly, regions of the door frame near the bottom of the door may not be sealed because any seal provided on the door frame may interfere with proper actuation of the mechanism to deploy a seal.

Accordingly, there can be regions around the bottom of a door that, despite the provision of a threshold sealing system, are devoid of any sealing. This can, at worst, obviate the use of such threshold seals since noise and/or smoke for example may be able to more easily pass the door at these unsealed regions.

According to an example, a threshold seal apparatus for a doorway includes a floor mounted seal that can extend end-to-end along the threshold of a doorway, and which does not require the use of any mechanism or seal within a rebate in the door itself, thereby enabling the doorway to be fully sealed both along the bottom of the door and around the door frame. Furthermore, no modification to an existing door is required.

FIG. 1 is a schematic representation of a threshold seal apparatus according to a first example. More particularly, FIG. 1 shows an end-on sectional (cut-away) view of a threshold seal apparatus 100 when in a retracted position or configuration. A floor-mountable channel portion 103 is provided, and a seal 105 is configured to be received within the channel portion 103. In an example, the seal is a compressible rubber gasket that compresses when it comes into contact with the bottom of a door, for example, in order to make a tight seal against the surface against which it comes into contact. An actuation mechanism (described in more detail below) is operable to move the seal 105 with respect to the channel portion 103 between a retracted position as shown and an extended position in which the seal 105 is configured to contact the underside of a door mounted within a doorway (not shown). The seal can be so profiled as to be received in a rail portion 241 (described below).

Figure 1A:
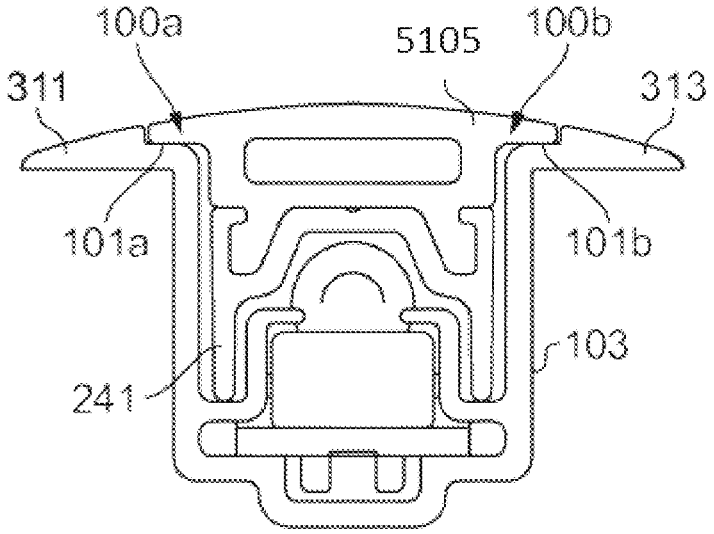
FIG. 1*a* is a schematic representation of a threshold seal apparatus according to a second example.

FIG. 1*a* is a schematic representation of a threshold seal apparatus according to a second example. The apparatus of FIG. 1*a* is the same as that of FIG. 1, except that the seal 5105 has overlapping flanges 100*a*, 100*b* at the top to prevent deleterious ingress into the channel 103, and has a slightly different profile. Accordingly, the profile of the rail 241 is so modified as to accept the seal 5105 as shown in FIG. 1*a*. In common with the apparatus of FIG. 1, the seal comprises a pair of feet that are configured to rest in corresponding channels of the rail so as to fix the seal in place in the rail. In FIG. 1 for example, the feet of the seal are u-shaped with parts that extend up into corresponding parts of the rail 241. In FIG. 1*a*, the feet are more c-shaped. It will be appreciated that there are numerous different suitable profiled for both the seal and the rail that could be selected by the skilled person. The examples shown are not intended to be limited, but provided merely to aid in the understanding of the relative disposition and function of the various components of the apparatus.

As shown in FIG. 1*a*, the lips 311, 313 of the channel 103 have corresponding recessed portions 101*a*, 101*b* in which the flanges 100*a*, 100*b* rest when the seal is in a configuration as shown in FIG. 1*a* (i.e. at rest within the threshold of a door).

Figure 2:
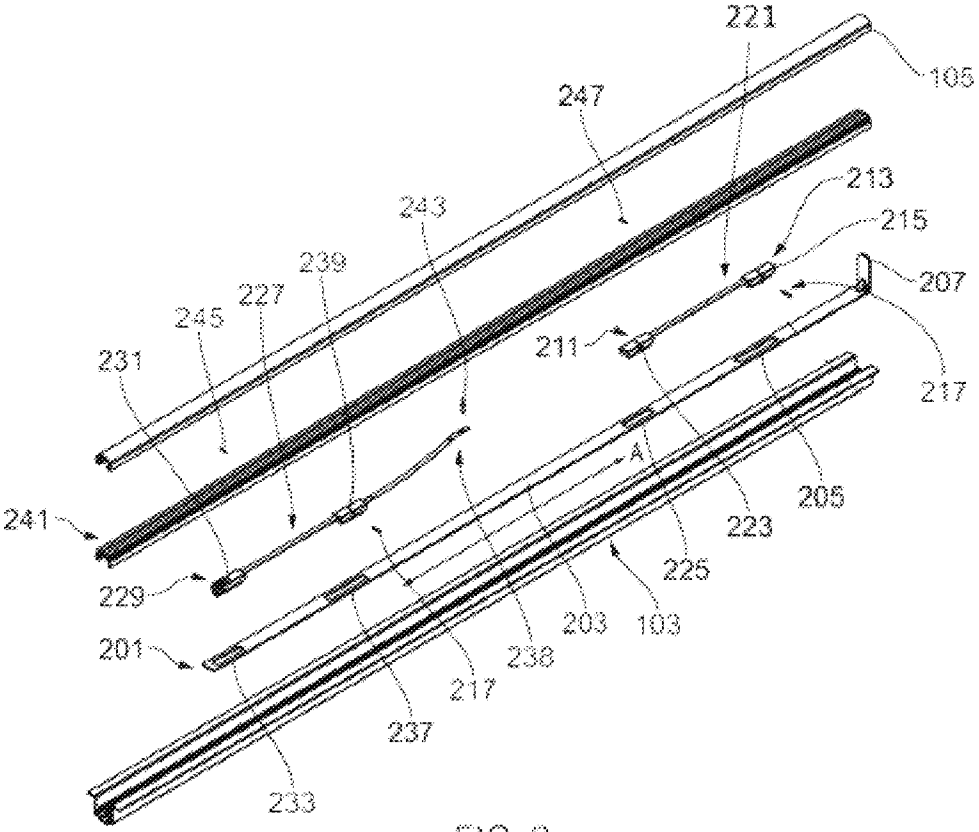
FIG. 2 is a schematic exploded view of the threshold seal apparatus according to the first example.

FIG. 2 is a schematic exploded view of the apparatus according to the first example. The actuation mechanism noted above comprises a slide bar 201 comprising an arm 203 configured to be slideably mounted in the channel portion 103. The slide bar is an elongate, channel mounted sliding element including specifically positioned apertures configured to engage and actuate components of an axially aligned and positioned device activation mechanism.

In an example, the arm 203 further includes an elongate opening 205 therethrough and a thumb portion 207 at one end. As shown in FIG. 2, the thumb portion 207 is configured to protrude substantially perpendicularly to a long axis (A) of the arm 203 from an end of the channel portion 103 when the arm is in situ in the channel portion 103. That is, when the apparatus is installed in a threshold position in the floor above a door for example, the thumb portion 207 is configured to protrude upwards from the floor/threshold, as broadly shown in FIG. 2.

In an example, as will be described in more detail below, multiple elongate openings can be provided in the arm 203 along with other corresponding openings through the arm 203. In an example, the openings are configured to accommodate mounting structures, some of which may be fixed or constrained within the openings, others of which may be free to move in at least one direction such as in a direction parallel to A for example. In an example, a pair of mounting structures is used in combination with a flexible member, such as leaf spring for example, as part of the actuation mechanism for the threshold seal apparatus. Such a spring may be composed of metal or plastic.

As shown in FIG. 2, a first elongate leaf spring 221 can be provided. One end 211 of the first leaf spring 221 can be mounted or affixed to the arm 203 and the other end 213 of the first leaf spring 221 can be mounted in the elongate opening 205. According to the example depicted in FIG. 2, the first leaf spring 221 is mounted in the elongate opening 205 using a first mounting block 215 that can be fixedly attached to the end 213 of the first leaf spring 221. The first mounting block 215 is configured to be free to travel in the elongate opening 205 in a direction parallel to the long axis of the arm, that is, the block 215 can travel back and forth in the opening 205 but is constrained from lateral movement. For example, the width of the first mounting block 215 can be configured to impede such lateral movement in the channel 205. In an example, feet can be provided on the block in order to stabilise the block in the opening and prevent lateral movement, as will be described in more detail below.

A restricting mechanism can be arranged on or as part of the apparatus in order to limit the movement of the first mounting block 215 within the elongate opening 205 relative to the channel portion 103 in at least one direction (A) as the slide bar 201 is moved relative to the channel portion 103. In the example shown in FIG. 2, the restricting mechanism is a rollpin 217. As shown in FIG. 2, the pin 217 is configured to pass through an opening 219 in block 215. A corresponding constriction on or in the channel portion 103 can be provided whereby to limit movement of the block including the rollpin as the block moves along the length of the channel portion 103. Alternatively, the restricting mechanism can comprise a constriction of the channel portion that prevents the block from moving past it without the use of a rollpin. For example, one or more indentations can be provided on the channel portion so configured as to limit movement of a mounting block within the channel portion in the at least one direction.

As shown in FIG. 1, mounting block 215 includes feet 107, although it will be appreciated that a single foot may be provided. The feet 107 are configured to engage in the elongate opening 205 whereby to maintain the block 215 in position and stabilise it within the channel. Other blocks as depicted in, for example, FIG. 2 can include a similar foot or feet in order to enable them to engage into corresponding channels on the arm 203. As shown in FIG. 2, the elongate opening 205 is longer, in a direction parallel to the long axis of the arm, A, than the length of the feet 107 on block 215 whereby to enable the first mounting block 215 to travel within the elongate opening 205. That is, block 213 can move back and forth in the channel 205. The limits of this motion of the block within the channel are defined by the length of the channel and the length of the feet. For example, for a given foot length, a relatively longer or shorter channel will permit respectively more or less movement of the block in question.

As noted above, a flexible member is provided and arranged between two mounting blocks. According to an example, and as depicted in FIG. 2 for example, a first leaf spring 221 can be mounted to the arm 203 using a second mounting block 223 fixedly attached to one end 211 of the spring 221. As noted above with reference to block 215, the second mounting block 223 can include a foot or feet configured to sit within a corresponding second opening 225 in the arm 203 arranged in spaced relation to the elongate opening 205.

As shown in FIG. 2, a second elongate leaf spring 227 can be provided. Similarly to the spring 221, one end 229 of the second leaf spring 227 can be mounted or affixed to the arm 203 using a further (third) mounting block 231 and corresponding channel 233 in the arm, and a further (fourth) mounting block 239, which is similar to block 215, can be mounted in a second elongate opening 237 of the arm 203. The spring 227 may extend from the block 239 instead of terminating at the block as in the case of spring 221. The terminal end 238 of the spring 227 can, in an example, be fixedly attached to a rail portion 241 configured to receive the seal 105 using, for example, a pin or rivet 243. The fourth mounting block 239 is configured to be free to travel in the second elongate opening 237 in a direction parallel to the long axis of the arm (A).

Similarly to spring 221, a restricting mechanism arranged on or as part of the apparatus can be provided in order to limit the movement of the fourth mounting block 239 within the second elongate opening 237 relative to the channel portion 103 in at least one direction as the slide bar 201 is moved relative to the channel portion 103.

According to an example, an interface between a leaf spring 221, 227 and the rail portion 241 can be provided in order to stabilise the springs as movement is induced, as will be explained in more detail below. The interface can be in the form of a roll pin (245, 247) for example, that passes through the rail portion 241 and over which the spring passes. That is, a portion of the spring sits between the rail portion and the interface.

Figure 3:
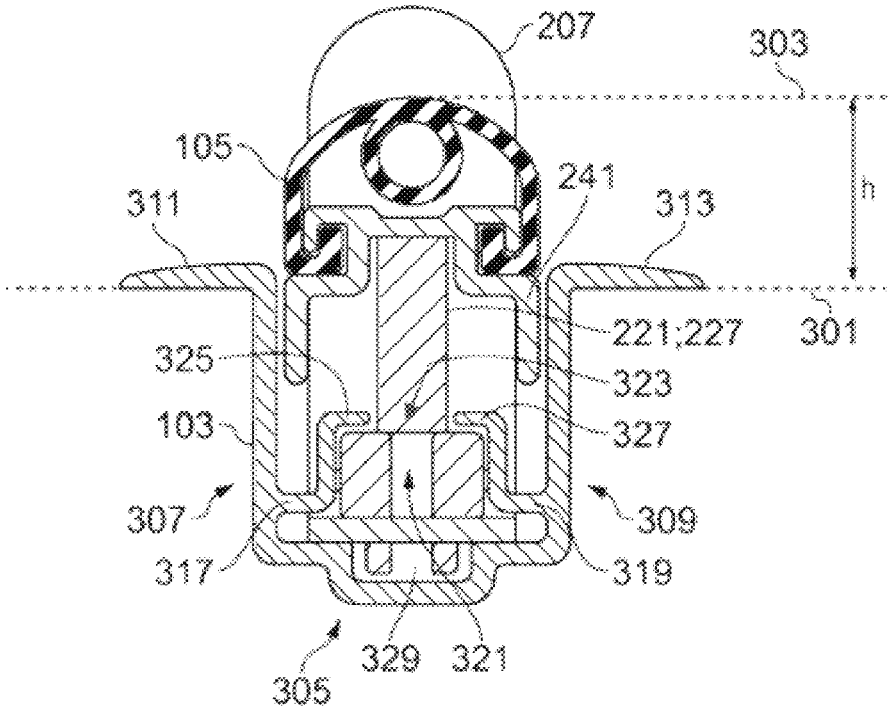
FIG. 3 is a schematic cross-sectional view of the threshold seal apparatus of the first example when in an extended configuration.

FIG. 3 is a schematic representation of a threshold seal apparatus according to the first example. More particularly, FIG. 3 shows an end-on sectional (cut-away) view of a threshold seal apparatus 100 when in an extended position or configuration. In FIG. 3, the level of a floor 301 is depicted. The top of the seal 105, in the extended position, is at a position 303 as depicted. The height, h, of the seal above the floor level in this configuration is shown. The channel portion 103 comprises a base 305 with a pair of walls 307, 309 depending therefrom, respective ones of the walls including a lip 311, 313 configured to extend substantially perpendicularly from the walls and in an outward direction relative to the channel defined by the base and walls. As can be seen, the lips (or flanges) are configured to overlap the edges of a suitable configured recess in the floor (not shown) into which the apparatus is to be installed in order to prevent the apparatus from falling into the recess. Additionally, the lips prevent migration of any detritus into the recess.

The channel portion 103 further comprises a pair of arms 317, 319 disposed within the channel, respective ones of the arms depending from the walls of the channel portion. The arms 317, 319 define an internal channel, broadly depicted at 321, which is configured to accommodate the mounting blocks and the arm of the apparatus. The internal channel 321 includes an opening 323 defined by a pair of lips 325, 327. In an example, the opening 323 is so dimensioned as to enable a leaf spring 221, 227 to extend outside of the internal channel 321.

In an example, the base 305 includes an indentation, channel or recess 329 configured to receive or accommodate a foot or feet of a mounting block. The arm 203 rests above the recess 329 and travels along the edges defined by the base and the recess as shown in FIGS. 1 and 3.

As can be seen in FIG. 3, the visible spring 221; 227 has been flexed whereby to cause the seal to move upwards. The seal is therefore biased in the retracted position until the actuation mechanism is used to move it into the extended position. In an example, the degree to which the actuation mechanism is deployed can be adjusted in order to enable modification of a maximum or minimum height of the seal when in the extended position. That is, the height h can be modified to accommodate variations in installation circumstances, such as variations in the gap between a door and a threshold.

Figure 3A:
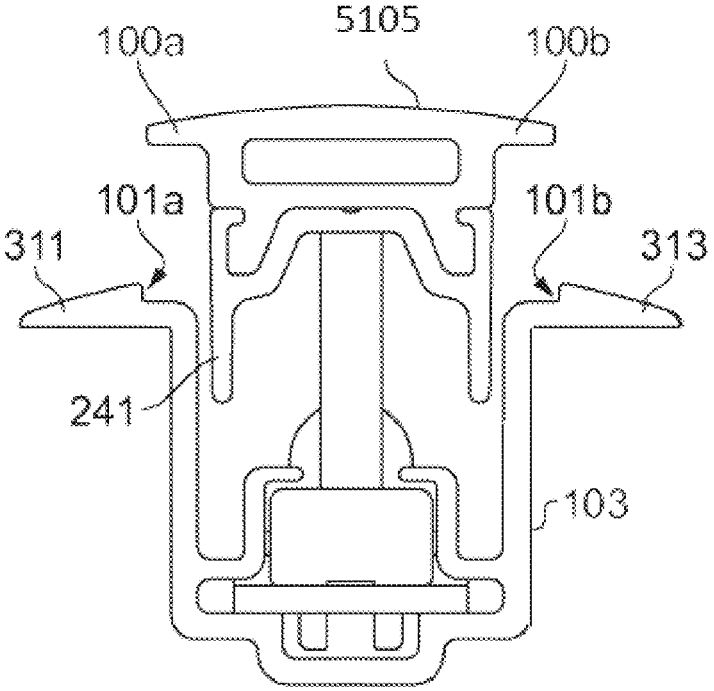
FIG. 3*a* is a schematic cross-sectional view of the threshold seal apparatus of the second example when in an extended configuration.

FIG. 3*a* is a schematic representation of a threshold seal apparatus according to the second example. The apparatus of FIG. 3*a* is the same as that described with reference to FIG. 1*a*, except that is in an open or deployed configuration in which the seal is extended. In both FIGS. 1*a* and 3*a* it will be noted that the thumb portion has been omitted from view for clarity only.

According to an example, the values for vertical travel of the seal for a given horizontal travel of the arm are related as:

| Horizontal travel Arm travel mm +/− 0.25 | Vertical travel Moving Rail + gasket seal mm +/− 0.25 | Mechanical Ratios Activation travel:Vertical Lift mm |
|---|---|---|
| 2.0 | 8.0 mm | 1:4 |
| 4.0 | 13.5 mm | 1:3.37 |
| 6.0 | 16.0 mm | 1:2.66 |
| 8.0 | 19.8 mm | 1:2.47 |
| 10.0 | 24.0 mm | 1:2.40 |

The addition of multiple lift springs as used in the production applications may create additional lift values compared to the values illustrated above.

As can be seen, a moderate horizontal travel produces a relatively larger vertical lift. A thumb portion position providing a maximum desired horizontal arm travel as a door or leaf is closed can therefore be selected. Although multiple discrete values are provided above, it will be appreciated that a thumb position resulting in any desired arm travel between maximum and minimum values can be obtained. For example, a minimum seal height in a deployed configuration can be 8 mm or less (horizontal travel of 2 mm or less), and a maximum seal height in a deployed configuration can be 24 mm (horizontal travel of 10 mm or more). Further levels of horizontal travel may result in a negligible increase in seal height (vertical travel) as the limits of the leaf springs and so on may be met. Nevertheless, typically, a vertical travel of between 8.0-24 mm will normally be sufficient to accommodate the gap under the vast majority of doors.

Figure 4:
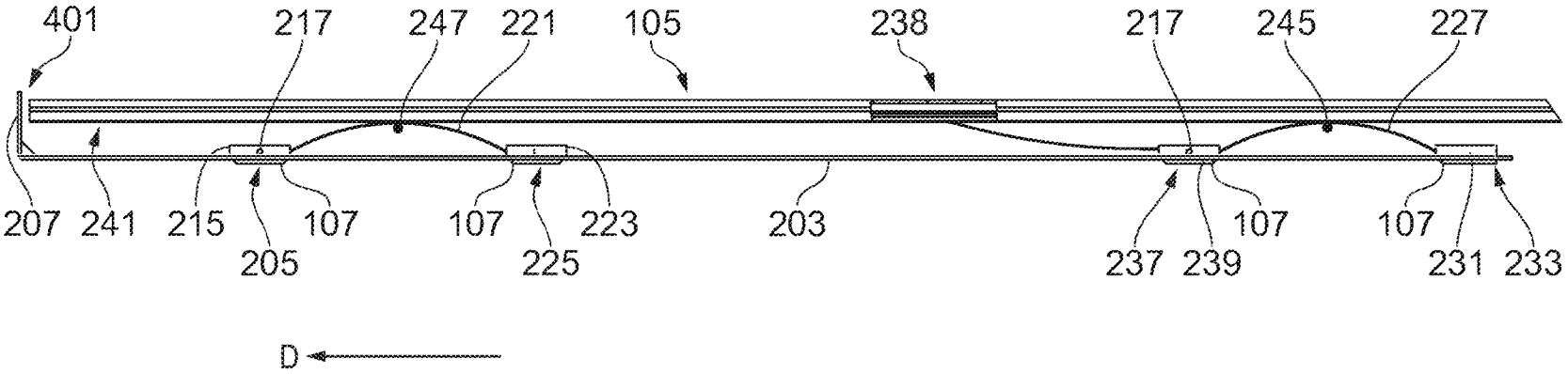
FIG. 4 is a side-on view of the apparatus of the first example in an extended configuration.

FIG. 4 is a schematic representation of a threshold seal apparatus according to the first example. More particularly, FIG. 4 is a side-on view of an apparatus in an extended or deployed position or configuration. Note that the channel portion 103 has been omitted in this figure for clarity. As can be seen in FIG. 4, springs 221 and 227 are flexed. That is, by virtue of the restriction mechanism, which in the example of FIG. 4 is depicted as the pins 217, movement of the blocks 215, 239 is limited as the arm moves in the direction D. With the blocks 215, 239 limited by how far they can move in the direction of D, the arm can continue to move however because of the elongate channels 205 and 237. That is, the elongate channels enable the arm to continue move with the blocks 215, 239 stationary relative to the channel portion by virtue of the fact that these channels are longer than the length of the blocks, or more particularly the foot or feet of the blocks which sit in the channels.

However, as blocks 231 and 223 are engaged in channels that do not extend beyond the length of the feet of these blocks, they will continue to move in direction D in unison with the arm as it is moved. Accordingly, the distance between the pairs of blocks 215, 223 and 231, 239 reduces, thereby causing the springs to flex upwards as shown so causing the rail portion 241 and thus the seal 105 to extend upwards.

As can be seen in FIG. 4, a small gap 401 is present between the edge of the thumb portion 207 and the rail portion 241 plus seal 105. That is, as a door is closed, an edge thereof will come into contact with the thumb portion 207. As the movement of the door continues to a closed configuration, the thumb portion 207 is therefore 'pushed' towards the door frame. The height h can be adjusted by varying the position of the thumb portion relative to the edge of the door that pushes it towards the door frame. There are numerous alternative options for such a variation. For example, the thumb portion can be provided as a separate part that can be attached to the arm using a bolt or similar for example. The position of the thumb portion on the arm, that is the extent to which the thumb extends from the arm, can thus be modified by changing the point at which the thumb is attached to the arm. For example, a channel can be provided in the arm or thumb, along with a corresponding bolt hole in the other of the elements such that the position can be varied by securing the thumb portion at a selected point within the channel using the bolt hole and bolt. Other alternatives are possible. For example, an asymmetrical cap can be provided that sits over the top of the thumb. This can be used to adjust the width of the thumb thereby varying the height h as a result of the door contacting the thumb plus cap. In an example, the cap can be a simple plastic or rubber u-shaped device in which one side is thicker than the other. An adjustable actuation mechanism according to an example is described in more detail below.

Figure 5:
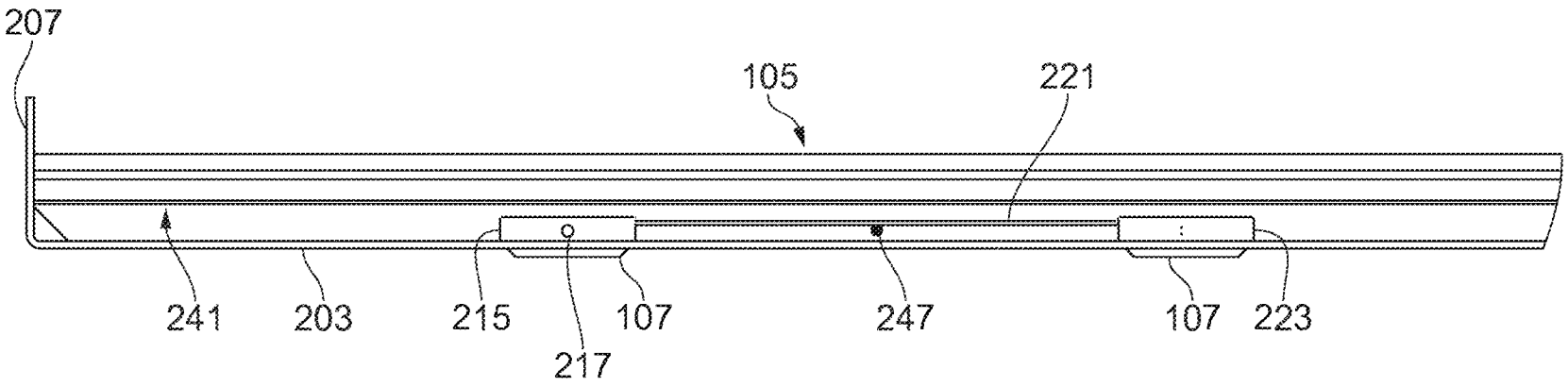
FIG. 5 shows a part of the apparatus of the first example in a retracted configuration.

FIG. 5 is a schematic representation of a portion of a threshold seal apparatus according to the first example. FIG. 5 shows a part of the apparatus (not showing the channel portion for the sake of clarity) in a retracted configuration, in which the spring 221 is not flexed and the seal 105 is biased in a retracted position.

Figure 6:
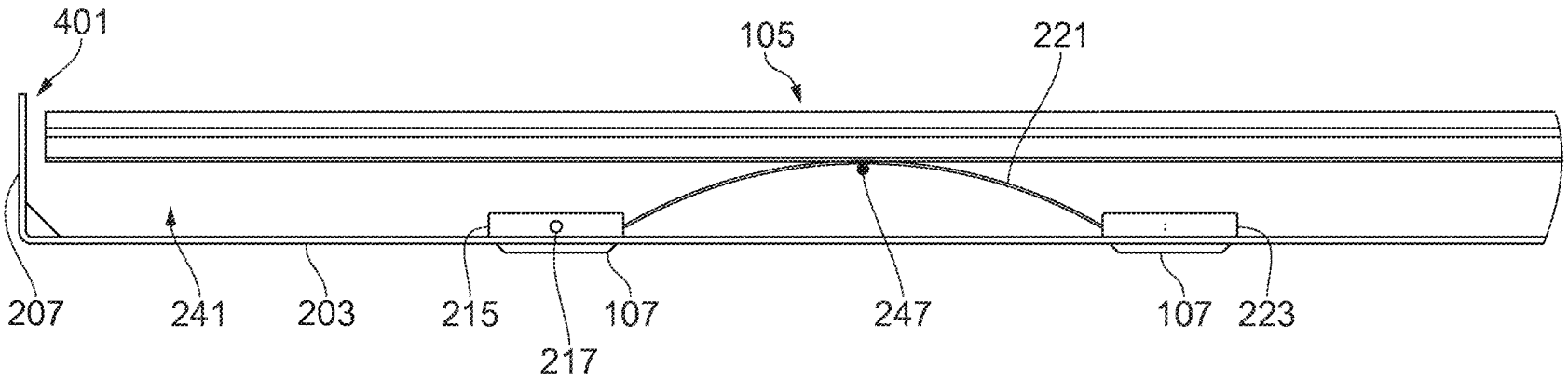
FIG. 6 corresponds to FIG. 5 but with the apparatus shown in an extended configuration.

FIG. 6 is a schematic representation of the portion of a threshold seal apparatus as shown in FIG. 5, according to the first example. FIG. 6 shows a part of the apparatus (not showing the channel portion for the sake of clarity) in an extended configuration, in which the spring 221 is flexed and the seal 105 is deployed. The position of the thumb and arm can be seen to have moved compared to the configuration shown in FIG. 5 resulting in gap 401 as the arm has been shifted in position.

Figure 7:
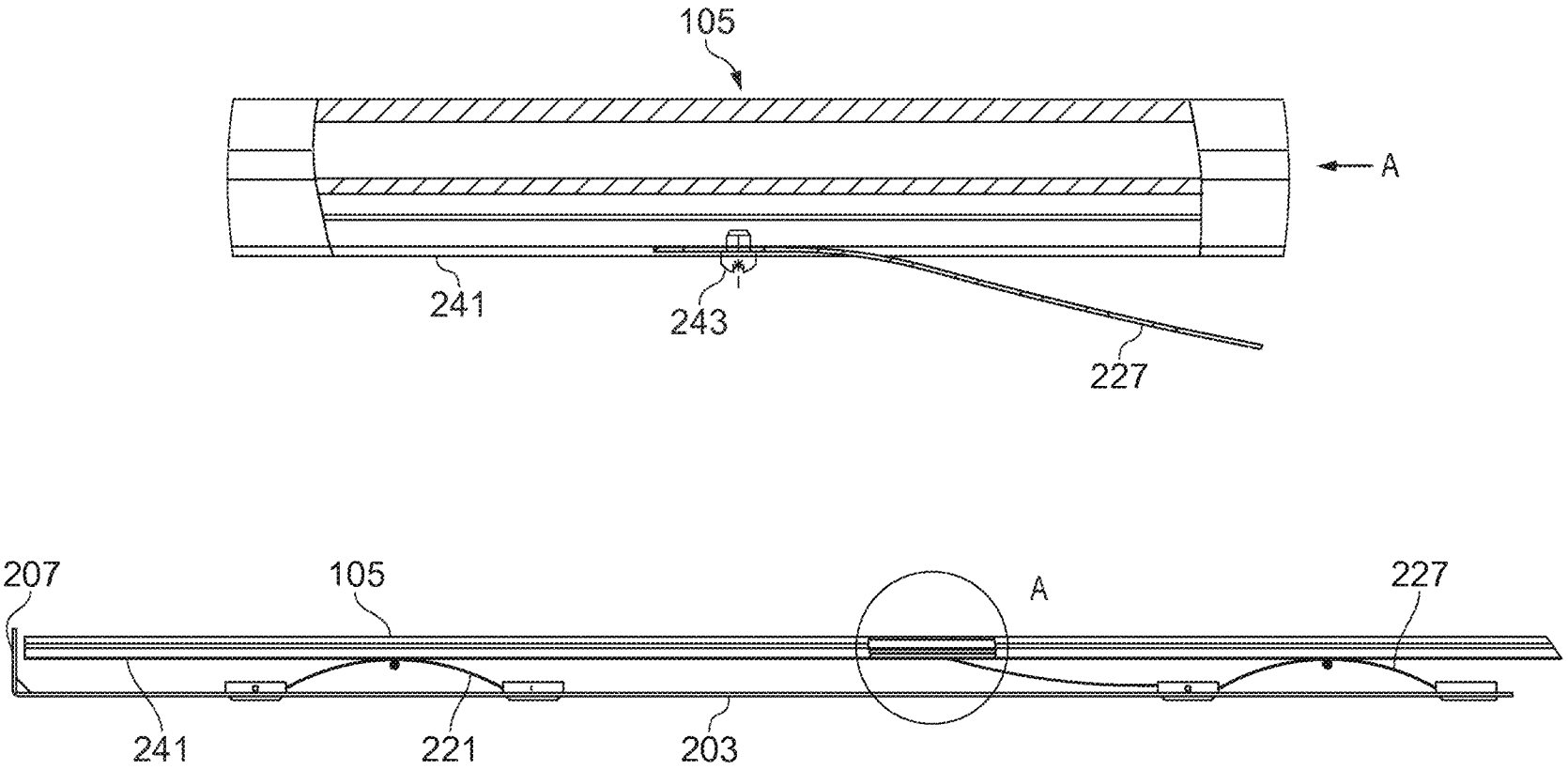
FIG. 7 is a schematic representation of an expanded view (A) of a part of the apparatus of the first example.

FIG. 7 is a schematic representation of a portion of a threshold seal apparatus according to the first example. More particularly, FIG. 7 depicts an expanded view (A) of part of spring 227 showing an example of how it may be connected to the rail portion 241. In the example of FIG. 7, a rivet 243 is used to fix the end of the spring 227 by way of a hole in the end of the spring to the underside of the rail portion 214. Other ways of fixing the spring will be apparent, such as adhesive, or providing a slot in the rail portion for the end of the spring to engage in for example. The fixing of the spring 227 in the manner shown in the accompanying figures provides stability for the apparatus, and minimises lateral movement of the rail portion and seal as the seal is deployed by moving the arm. This therefore enables a repeatable and precise seal deployment, in which the seal contacts the underside of a door, to be achieved.

Figure 8:
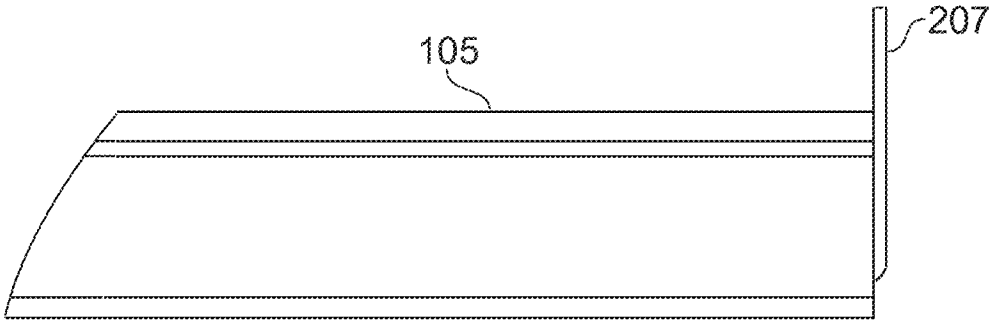
FIG. 8 is a schematic representation of a portion of a threshold seal apparatus according to the first example showing a thumb and seal in a retracted position.
Figure 9:
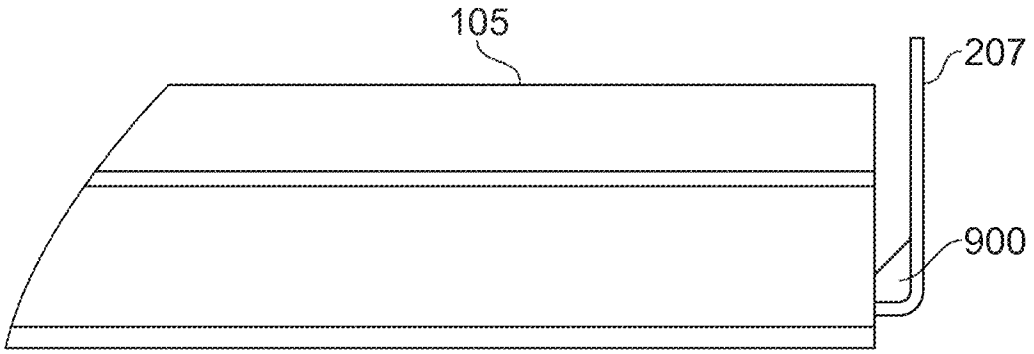
FIG. 9 corresponds to FIG. 8 but with the thumb extended and the seal in a deployed configuration.

FIGS. 8 and 9 are schematic representations of a portion of a threshold seal apparatus according to the first example. FIG. 8 shows the thumb and seal in a retracted position. FIG. 9 shows the thumb 207 extended and the seal 105 in a deployed configuration. A corner brace element 900 is visible in FIG. 9 that reinforces the thumb/arm interface/join. This is also visible in, for example, FIG. 2.

Figure 10:
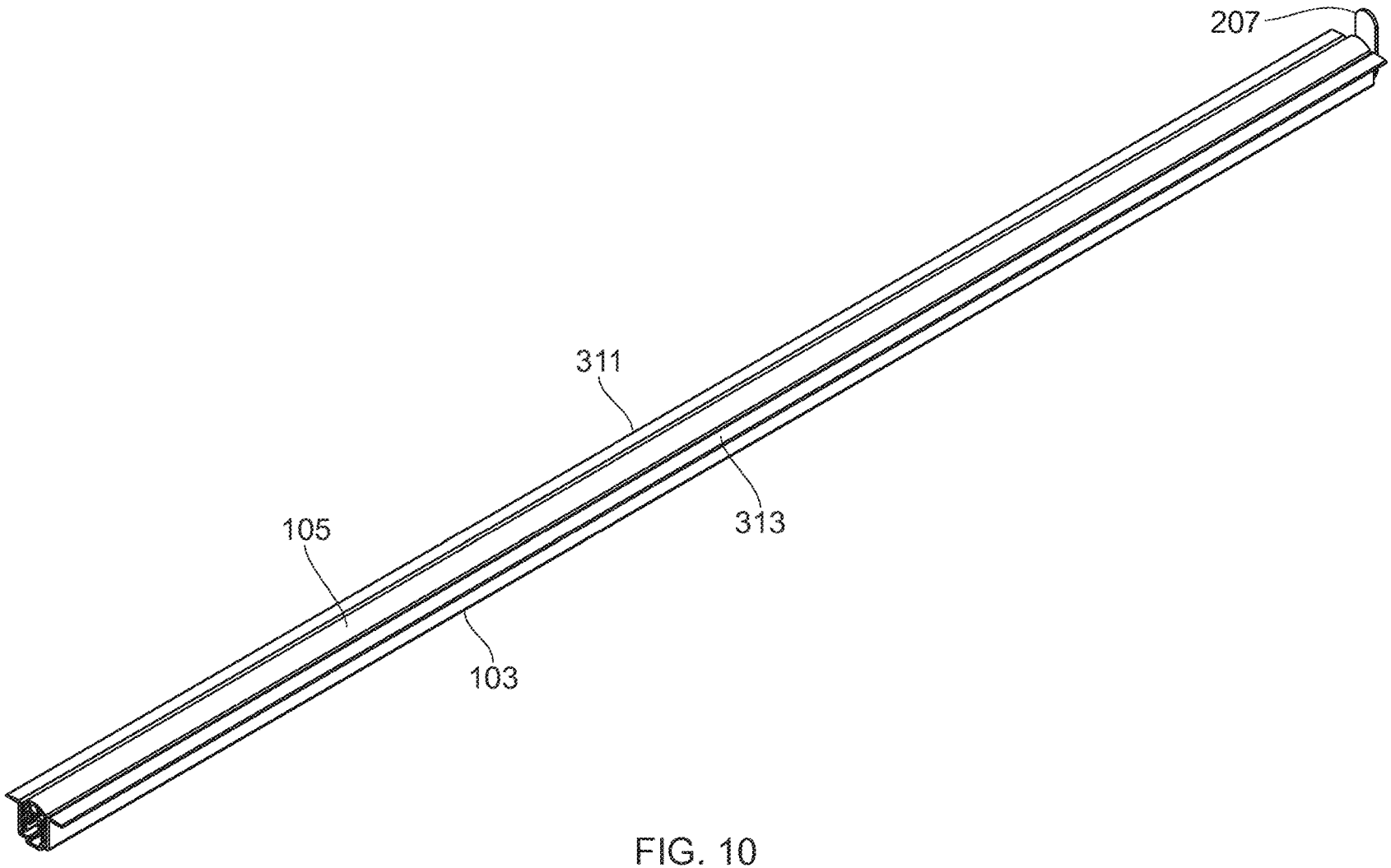
FIG. 10 is a schematic representation of the threshold seal apparatus according to the first example showing the thumb and seal in a retracted position.
Figure 11:
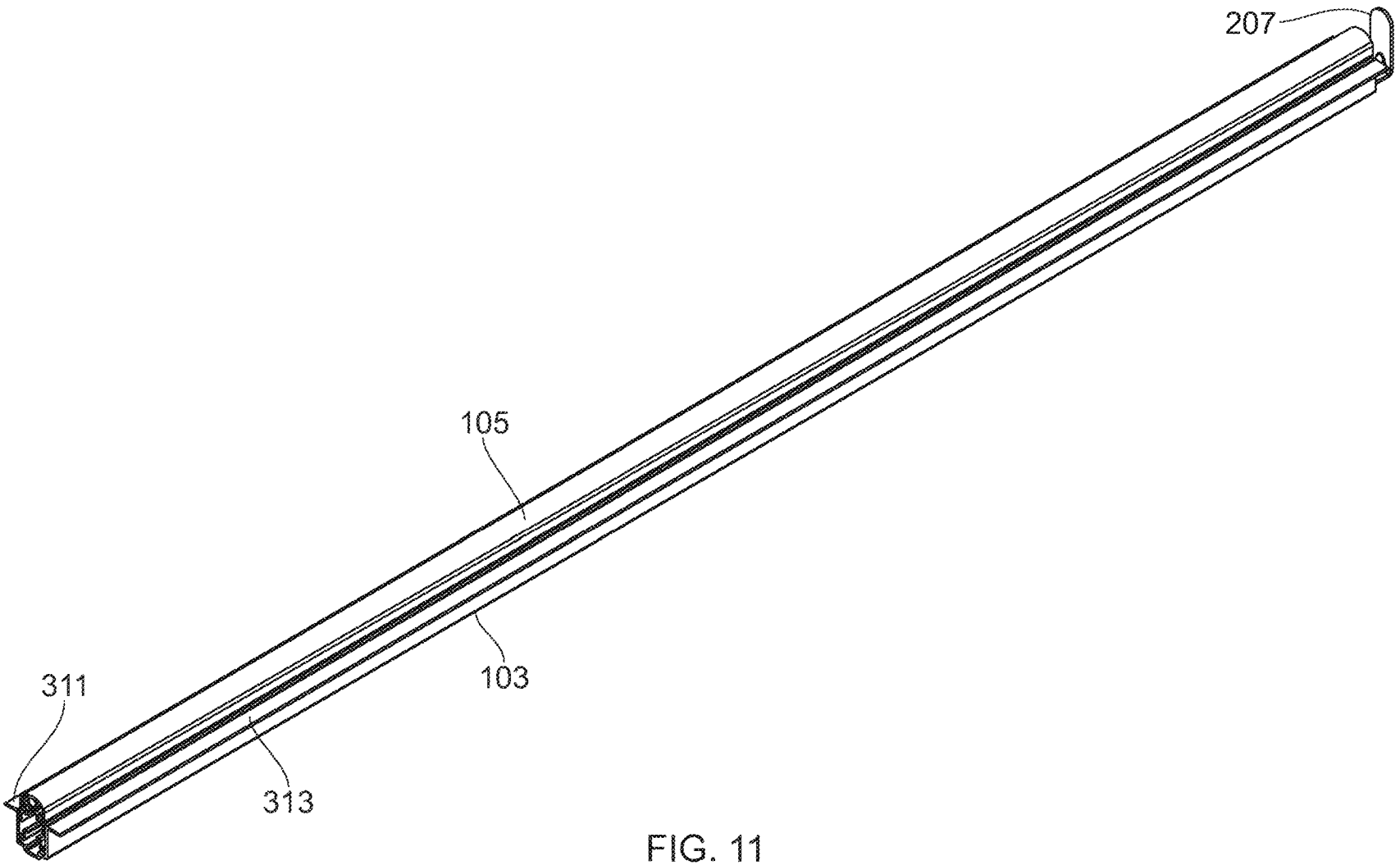
FIG. 11 corresponds to FIG. 10 but with the thumb extended and the seal in a deployed configuration.

FIGS. 10 and 11 are schematic representations of a threshold seal apparatus according to an example. FIG. 10 shows the apparatus in a retracted position. FIG. 11 shows the apparatus in an extended position in which the seal is deployed.

Figure 12:
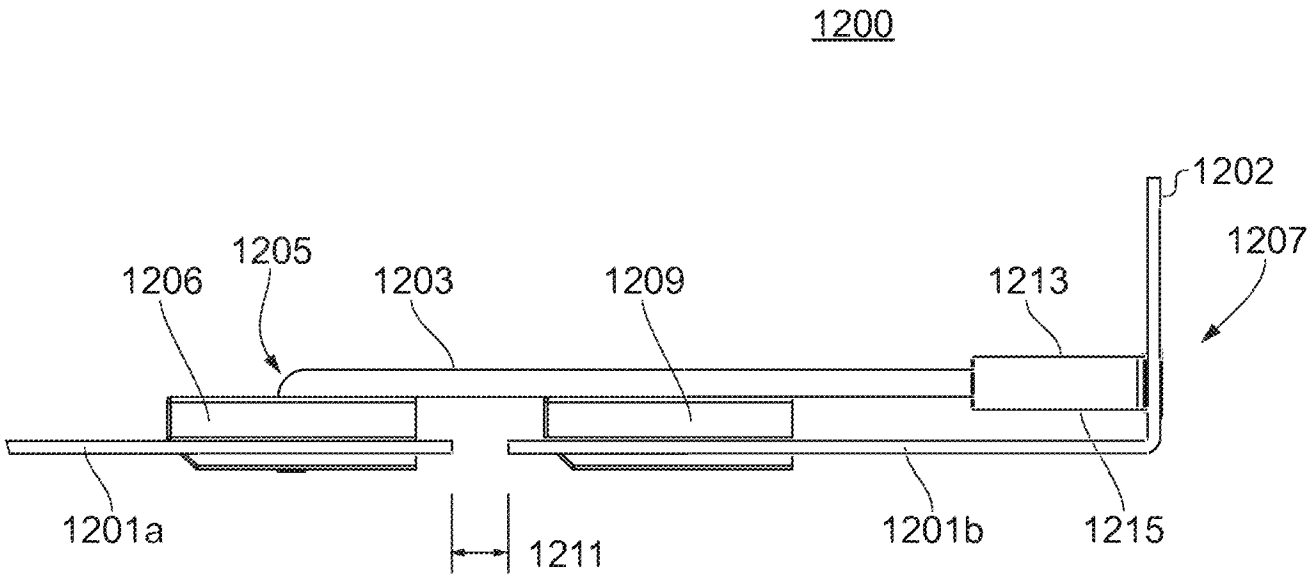
FIG. 12 is a schematic representation of a side view of one end of an actuation mechanism according to an example.

FIG. 12 is a schematic representation of a side view of one end of an actuation mechanism according to an example. The actuation mechanism as shown in FIG. 12 is adjustable, whereby to enable the height h to be modified by varying the position of the thumb portion relative to the edge of the door that pushes it towards the door frame. That is, as the position of the thumb portion relative to the arm part 1201*a* (i.e. as the position of the arm part 1201*b* relative to the arm part 1201*a*) is modified using the adjustment arm 1203, the degree to which the seal 105 is raised as the actuation mechanism is deployed can be varied. For example, as the width of the gap 1211 is reduced by bringing the arm parts closer together, the thumb portion 1202 will not contact a door jamb as soon as it would if the gap 1211 were relatively wider because the thumb portion does not extend or protrude from the apparatus to the same extent. The thumb portion can therefore only travel a relatively smaller distance before the door is closed, and so the degree to which the seal rises will be less than that compared to the case when the thumb portion extends to a greater degree (inasmuch as the gap width 1211 is relatively larger). Accordingly, the height h of the seal in a deployed position can be varied by varying the width of the gap 1211 as will be described in more detail below.

With reference to FIG. 12, the arm of the mechanism 1200 is split into multiple arm parts 1201*a*, 1201*b*. The thumb portion 1202 is connected to or part of the arm part 1201*b*.

The arm parts 1201*a* and 1201*b* are linked using an adjustment or connecting arm 1203, which is coupled at one end 1205 thereof to the arm part 1201*a* via a mounting block 1206 and at the other end 1207 to the arm part 1201*b*. A further mounting block 1209 can be provided in the arm part 1201*b*.

According to an example, the adjustment arm 1203 is not linked mechanically to block 1209, it simply slides over it. Both blocks 1206, 1209 run in their own track extruded within the main carrier/body (103) of the device as described above. Block 1209 prevents the arm part 1201*b* from tipping up in the air as a door strikes the mechanism, and without this, any clockwise rotations would translate to the arm as rotational forces causing the unit to simply fall or tip over backwards from the door strike. Block 1209 arrests all such rotational forces and keeps the actuation mechanism sliding in a linear fashion.

An adjustment gap 1211 is provided between the arm parts 1201*a* and 1201*b*. A threaded adjustment control structure 1213 is provided at end 1207 of the adjustment arm 1203 connected to the thumb 1202. In an example, the control structure 1213 comprises an internally threaded sleeve 1215 into which a corresponding threaded portion of the adjustment arm 1203 engages. As the sleeve 1215 is rotated, the arm 1203 is cause to move in a direction in and out of the sleeve, depending on the direction of rotation of the sleeve 1215, thereby causing the relative position of the arm parts 1201*a* and 1201*b* to vary by a desired degree that is controlled by the amount of rotation applied to the sleeve 1215.

For example, the arm parts 1201*a* and 1201*b* may be brought closer together, thereby reducing the gap 1211, and in the limit that the gap 1211 is zero, the arm parts are in contact.

In the opposite direction of adjustment, the maximum separation of the arm parts is limited by the degree to which the threaded portions of the sleeve and arm 1203 can be adjusted before the threaded portion of the arm 1203 no longer engages with any corresponding internal thread of the sleeve. As is typical, each thread on the arm and in the sleeve can be a helical thread.

A part (see for example FIGS. 15-17) of the sleeve 1215 can be externally profiled in order to enable adjustment by rotation. For example, the externally profiled part can be formed as a hexagon, or similar, to enable a spanner to be used to rotate the sleeve. The operation of doing this can be helped by virtue of the fact that the door catching arm can be pushed back a little to get the spanner in.

Figure 13:
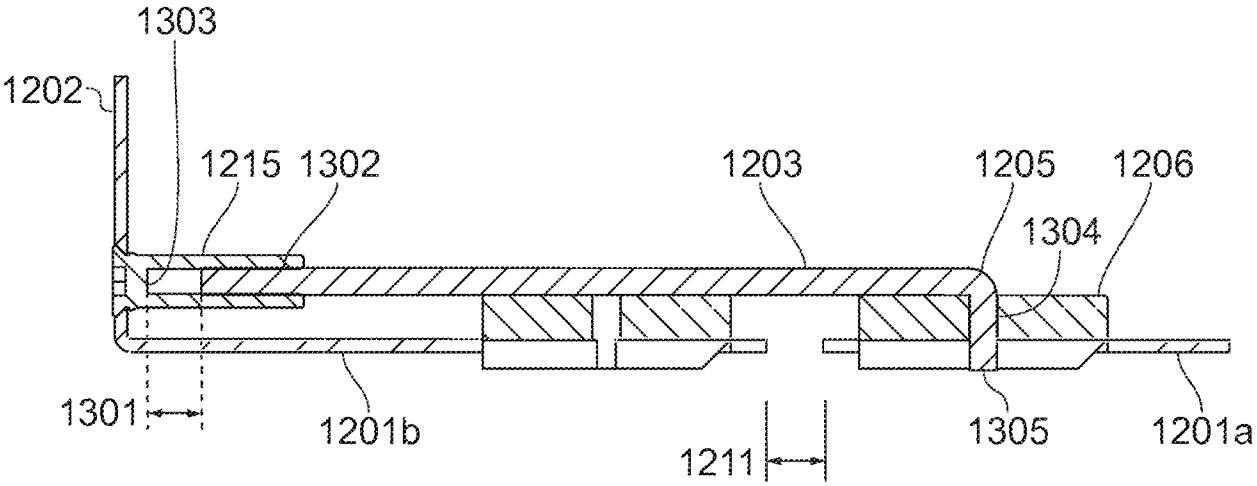
FIG. 13 is a schematic cross-sectional view of the end of the actuation mechanism.

FIG. 13 is a schematic representation of the end of the actuation mechanism according to an example as shown in FIG. 12. More specifically, FIG. 13 is a cross-sectional view, albeit shown from the opposite side of the mechanism compared to that shown in FIG. 12. Sleeve 1215 is shown in cross-section, with the adjustment arm 1203 engaged therein using threaded portions on the outside of the end of the arm 1203 and the inside 1302 of the sleeve. The distance 1211 between the arm parts is substantially the same as the gap 1301 between the end of the adjustment arm 1203 in the sleeve and the closed end 1303 of the sleeve. Accordingly, as the sleeve is rotated in the appropriate direction, the gap 1301 reduces by the same degree as the gap 1211, thereby bringing the arm part 1201*a* and 1201*b* together.

As can be seen in FIG. 13, the end 1205 of the arm 1203 comprises a finger portion 1305 that is received in a corresponding aperture 1304 in block 1206, whereby to hold this end of the arm 1203 securely in place. In an example, the aperture can be slightly narrower than the width of the finger 1305 to provide an interference fit between the finger 1305 and the aperture. To aid in assembly and minimisation of different parts, all blocks may include an aperture.

Figure 14:
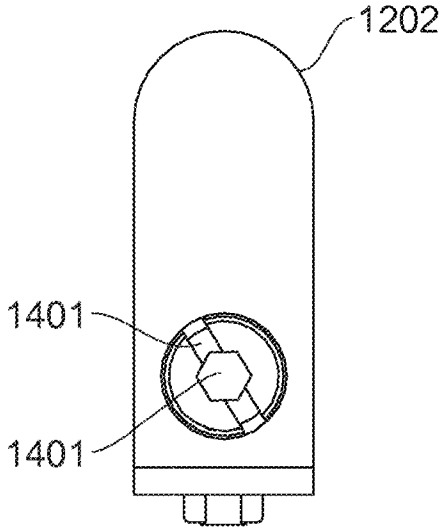
FIG. 14 is a an end view of the actuation mechanism.

FIG. 14 is a schematic representation of an actuation mechanism according to an example. More particularly, FIG. 14 is an end view showing the thumb portion 1202 and the end of the sleeve 1215, which, as can be seen from FIGS. 12 and 13 can extend through the thumb portion 1202. The sleeve 1215 can be restricted from passing all the way through the aperture by virtue of a wider or appropriately profiled end section, as shown in FIG. 13 for example, which causes the end of the sleeve 1215 to sit within the aperture.

The end of the sleeve 1215 can include one or more profiled portions 1401 to enable the sleeve to be rotated. For example, as shown in FIG. 14, a slot can be provided so that a screwdriver can be used to rotate the sleeve. In addition, or instead of this, a hexagonal recess can be provided for an allen key. Various other suitable profiles are possible as will be appreciated.

Figure 15:
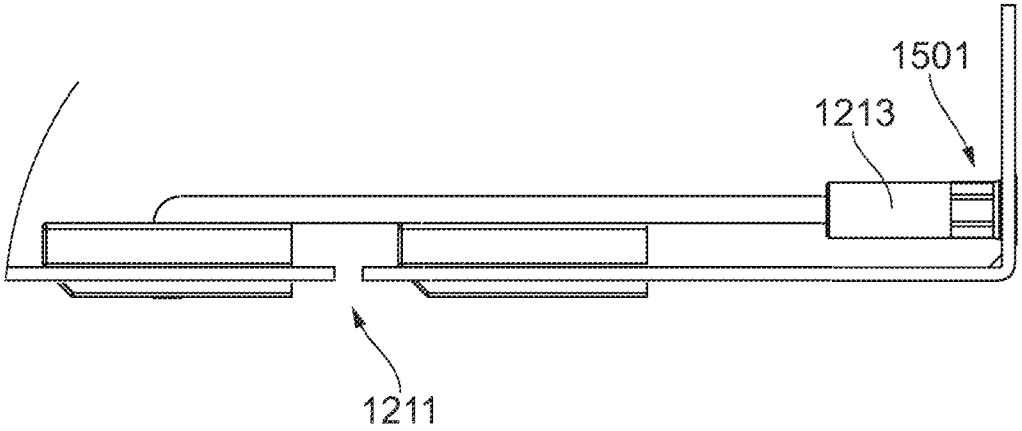
FIG. 15 is a schematic representation of an end of an actuation mechanism according to an example.
Figure 16:
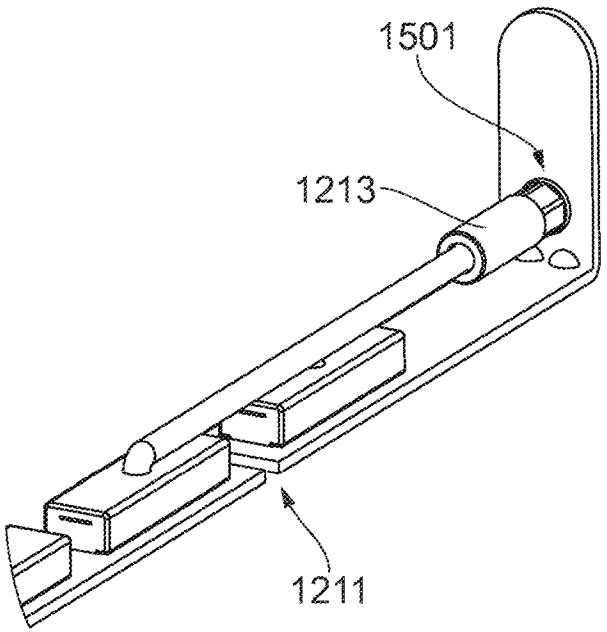
FIG. 16 is a schematic representation of a perspective view of the end of the actuation mechanism according to an example as shown in FIG. 15.
Figure 17:
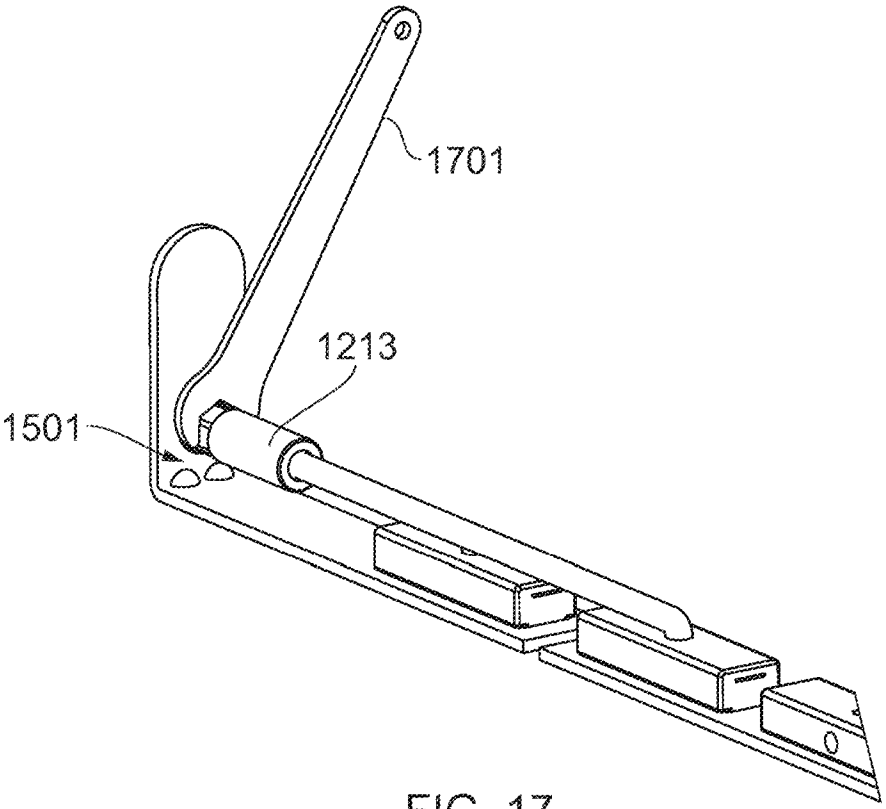
FIG. 17 is a schematic representation of the end of the actuation mechanism according to an example as shown in FIGS. 15 and 16 in which a spanner is depicted engaged with an outer profile of a sleeve of the actuation mechanism.

FIG. 15 is a schematic representation of the end of the actuation mechanism according to an example. An outer profiled portion 1501 can be seen, which can be used to rotate the sleeve 1213 in order to modify the width of the gap 1211. FIG. 16 is a schematic representation of a perspective view of the end of the actuation mechanism according to an example as shown in FIG. 15. FIG. 17 is a schematic representation of the end of the actuation mechanism according to an example as shown in FIGS. 15 and 16, in which a spanner 1701 is depicted engaged with the outer profile 1501 of the sleeve 1213.

Figure 18:
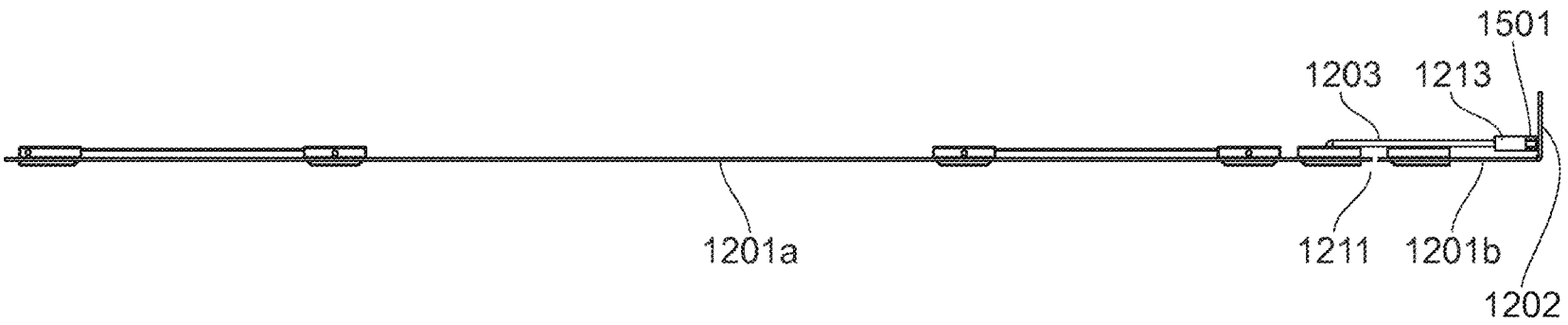
FIG. 18 is a schematic representation of the actuation mechanism of FIGS. 15 and 16 forming part of a threshold seal apparatus.

FIG. 18 is a schematic representation of an apparatus according to an example. Arm parts 1201*a* and 1201*b* are shown, and the relative position of the adjustment arm 1203 can be seen.

Figure 19:
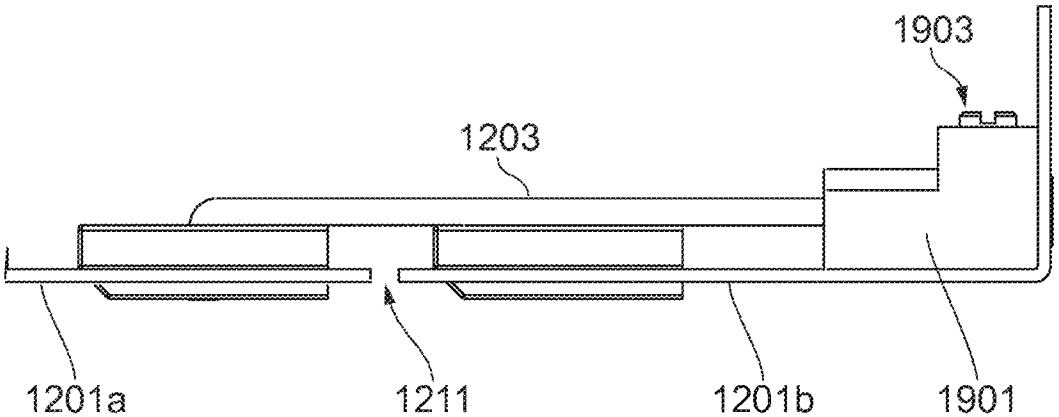
FIG. 19 is a schematic representation of an end of an actuation mechanism according to an example.
Figure 20:
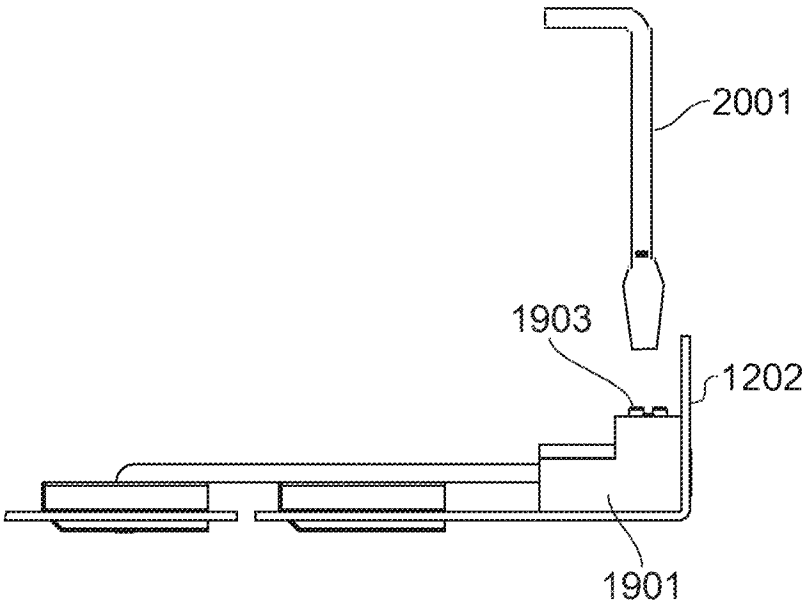
FIG. 20 is a schematic representation of the end of the actuation mechanism according to an example as shown in FIG. 19.

FIG. 19 is a schematic representation of the end of the actuation mechanism according to an example. In the example of FIG. 19, an alternative structure for modifying the width of the gap 1211 is provided. More specifically, a 90 degree winding gearbox 1901 is provided that can be used to wind the sleeve 1213 (not shown) along the adjustment arm 1203. The gearbox 1901 can translate a vertical rotation, as the screw part 1903 is rotated, to a horizontal rotation which can be used to rotate the sleeve. In this connection, FIG. 20 is a schematic representation of the end of the actuation mechanism according to an example as shown in FIG. 19 in which a screwdriver or allen key or similar 2001 is depicted. This can be used to rotate the part 1903. The gearbox 1901 can thus enable access from the top of the apparatus, which may be useful in certain circumstances, such as during installation, or to provide an adjustment mechanism while the apparatus is in situ (as the thumb portion 1202 can be pulled outwards from a door to enable access to part 1903 for example).

Figure 21:
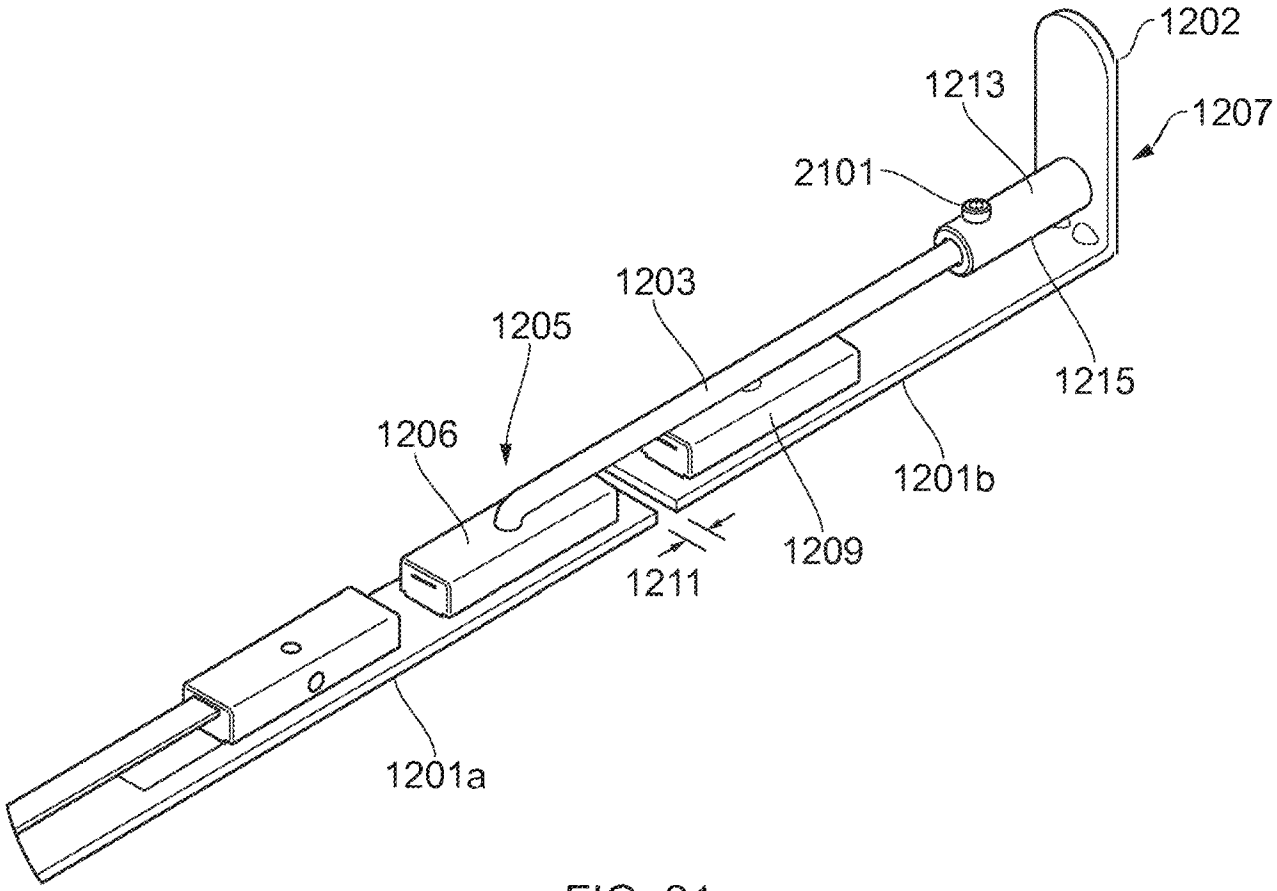
FIG. 21 is a schematic representation of an end of an actuation mechanism according to an example.

FIG. 21 is a schematic representation of the end of the actuation mechanism according to an example. Similarly to that described above with reference to FIGS. 1 to 20, the arm of the mechanism 1200 is split into multiple arm parts 1201*a*, 1201*b*. The thumb portion 1202 is connected to or part of the arm part 1201*b*.

The arm parts 1201*a* and 1201*b* are linked using an adjustment or connecting arm 1203, which is coupled at one end 1205 thereof to the arm part 1201*a* via a mounting block 1206 and at the other end 1207 to the arm part 1201*b*, and which is not threaded. A further mounting block 1209 can be provided in the arm part 1201*b*.

Sleeve 1215 includes a grub screw adjuster 2101. When tightened this holds the arm 1203 firmly in place within the sleeve. When the grub screw 2101 is released, the door catching arm (thumb portion 1202) slides back or forth to the desired position subject to the door gap to alter the gap 1211. Towards the device creates more lift for larger door gaps—away from the device reduces lift where gaps are small.

In an example, sleeve 1215 is fully (internally) threaded end to end even though the arm 1203 is not. The arm 1203 can be a smooth rod bent at one end to pass through the top of block 1206. Having the sleeve 1215 fully threaded creates very high grip when the grub screw 2101 is tightened thereby locking the connecting rod 1203 inside the coupler. This works like a re-bar coupler where a helical thread form provides all the grip as the cross bolts are tightened.

Figure 22:
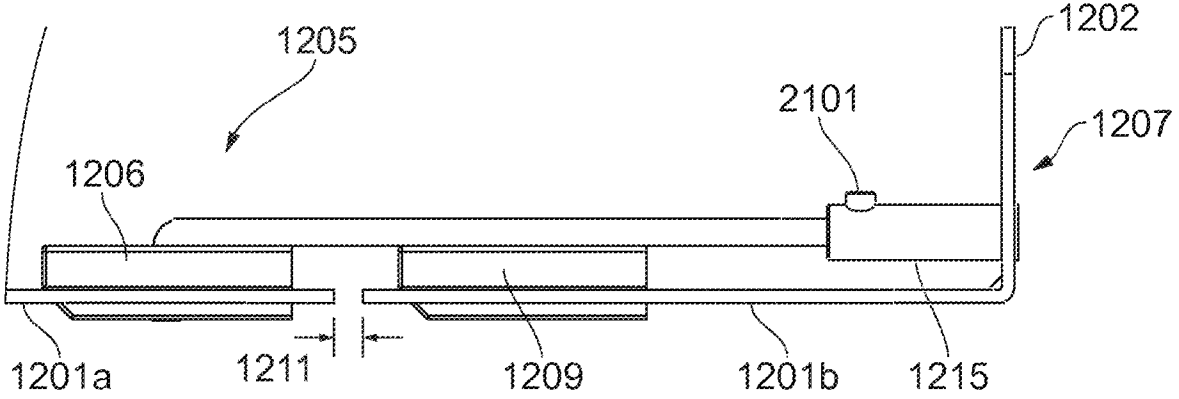
FIG. 22 is a schematic representation of a side view of the mechanism portion depicted in FIG. 21.

FIG. 22 is a schematic representation of a side view of the mechanism portion depicted in FIG. 21.

Figure 23:
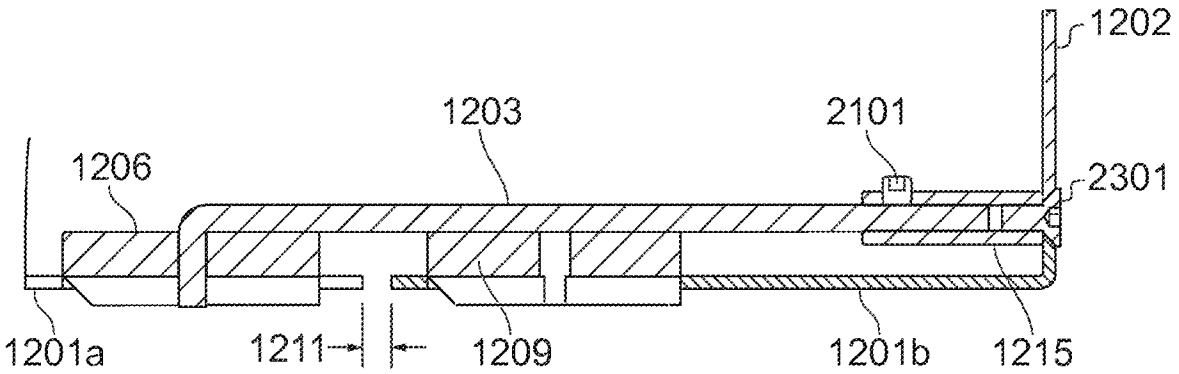
FIG. 23 is a schematic representation of a side view of the mechanism portion depicted in FIG. 21, in cross-section.

FIG. 23 is a schematic representation of a side view of the mechanism portion depicted in FIG. 21, in cross-section. A socket screw or similar 2301 is depicted, and as can be seen this secures the sleeve 1215 to the end of the mechanism via an aperture in the thumb portion 1202. The grub screw adjuster 2101 is shown screwed down so that it is contact with the arm 1203, thereby holding it in place in the sleeve and fixing the position of the parts 1201*a* and 1201*b* to define a desired width 1211 that will result in given height h for the seal by virtue of thumb portion 1202 protruding from the door (when open).

Figure 24:
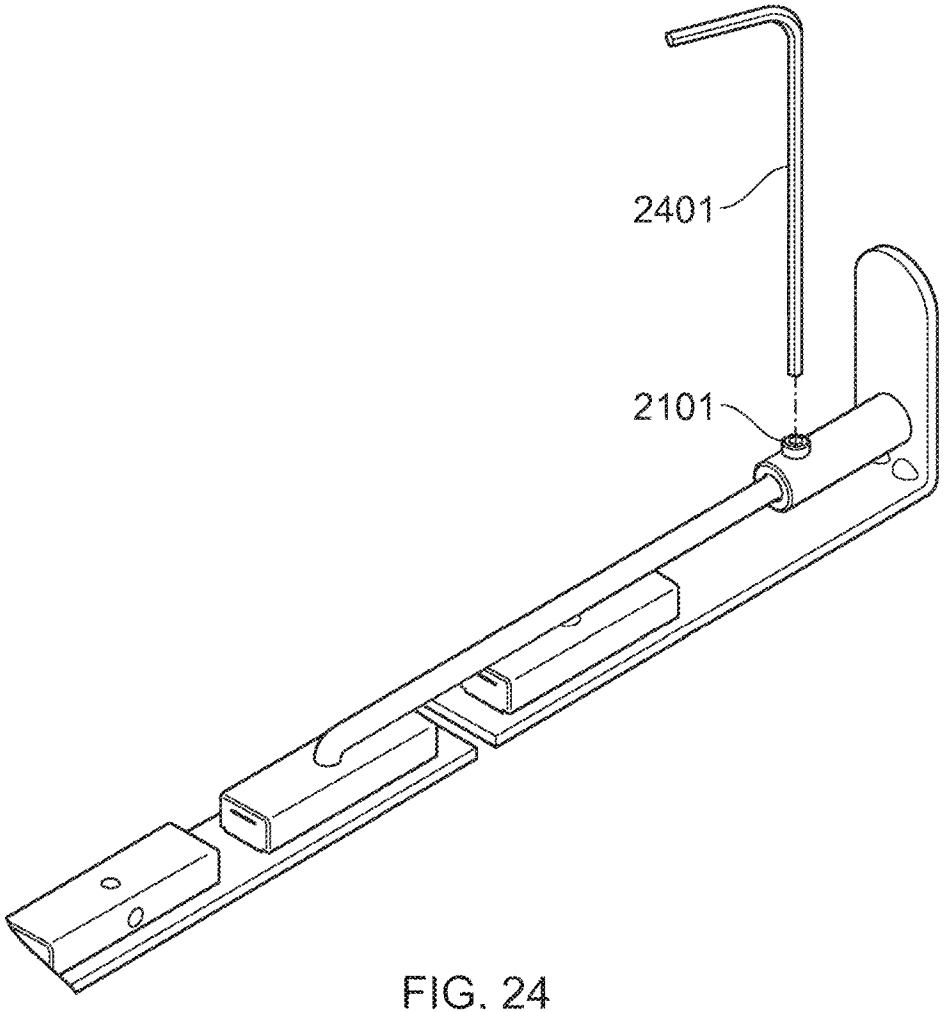
FIG. 24 is a schematic representation of the mechanism portion depicted in FIG. 21.

FIG. 24 is a schematic representation of the mechanism portion depicted in FIG. 21. An allen (hex) key, or similar device 2401, can be used to tighten/loosen the grub screw adjuster 2101.

Figure 25:
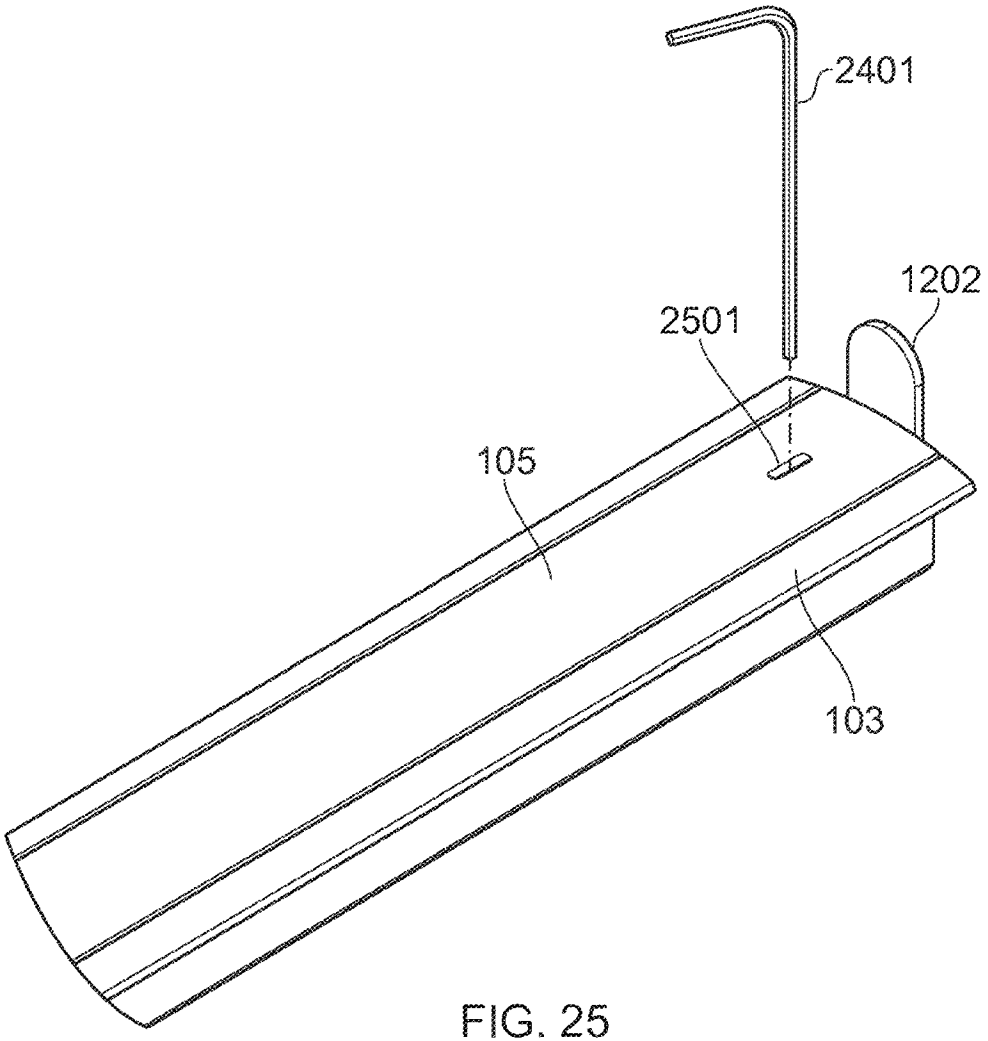
FIG. 25 is a schematic representation of the mechanism portion depicted in FIG. 21 but shown with a seal in place.

FIG. 25 is a schematic representation of the mechanism portion depicted in FIG. 21. As shown in FIG. 25 the seal 105 is shown as well as channel portion 103. An aperture or opening 2501 is provided in the seal through which the device 2401 may pass in order to enable the grub screw 2101 to be tightened/loosened whilst the apparatus is in situ without the need to dismantle any parts in order to gain access to the screw 2101.

Figure 26:
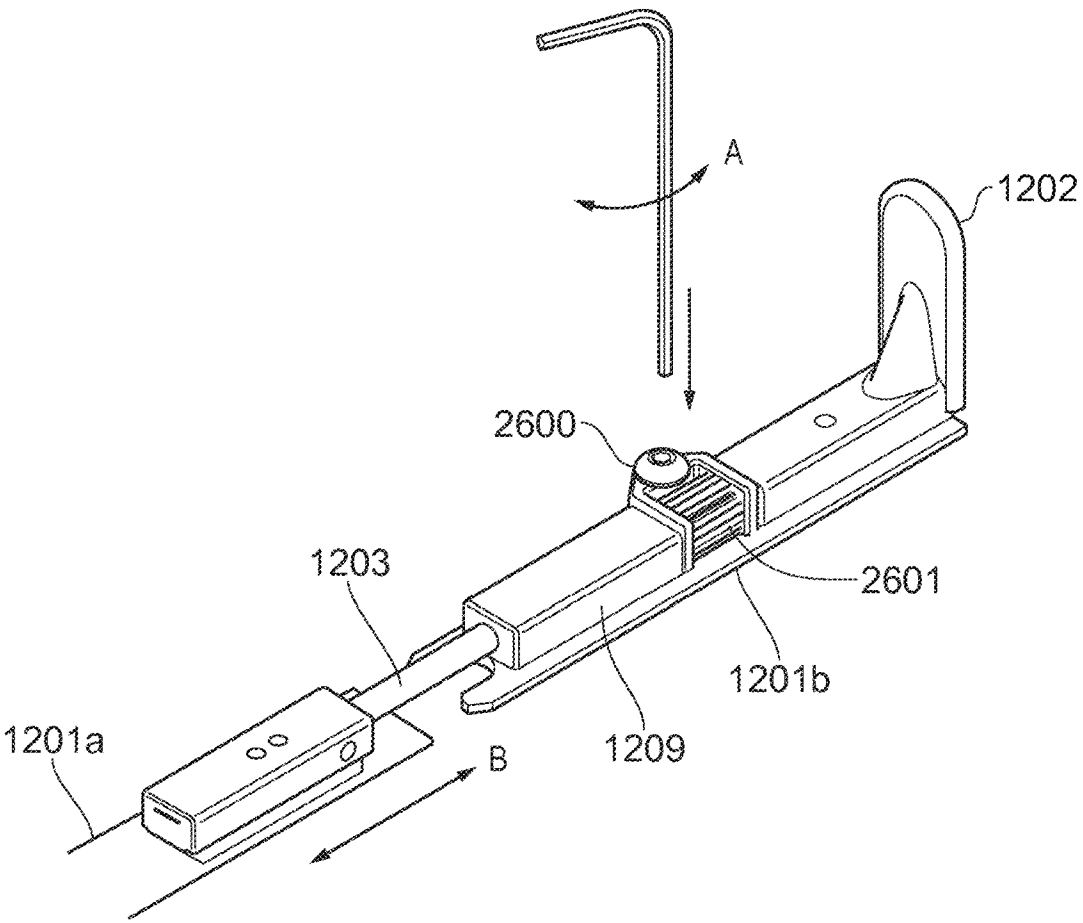
FIG. 26 is a schematic representation of an end of an actuation mechanism according to an example.

FIG. 26 is a schematic representation of the end of the actuation mechanism according to an example. Similarly to that described above, the arm of the mechanism 1200 is split into multiple arm parts 1201*a*, 1201*b*. The thumb portion 1202 is connected to or part of the arm part 1201*b*.

The actuation mechanism in the example of FIG. 26 is in the form of a worm 2600 and wheel 2601 forming a worm drive. Directional arrows indicate part rotation, and the directional adjustment achieved. That is, when the worm 2600 is rotated, using for example a screw driver or allen key and so on, in the direction A, there is a corresponding movement of the wheel 2601 that causes the part 1201*a* to move in the direction B.

As is typical, the worm 2600, which is a gear in the form of a screwthread, meshes with a gear or wheel 2601. As the worm is rotated, there is a corresponding rotation of the wheel 2601 which comprises multiple teeth that engage with the screwthread of the worm 2600. The arm 1203 can terminate in a screwthreaded portion (not shown) inside the block 1209. A corresponding screwthreaded portion can be attached to the wheel 2601 that is configured to receive the screwthreaded end of the arm 1203. Accordingly, as the wheel 2601 rotates (as a result of rotation of the worm 2600), the screwthreaded sleeve rotates causing the arm to be drawn into or out of the sleeve dependent on the direction in which the worm 2600 is rotated. This is similar to the way in which the adjustment mechanism as described with reference to FIG. 12 operates inasmuch as there is a sleeve with an internally threaded portion connected to wheel 2601 that is used to modify the position of the arm 1203 which itself comprises a threaded end portion to fit inside the sleeve and engage with the internal thread provided thereon.

Figure 27:
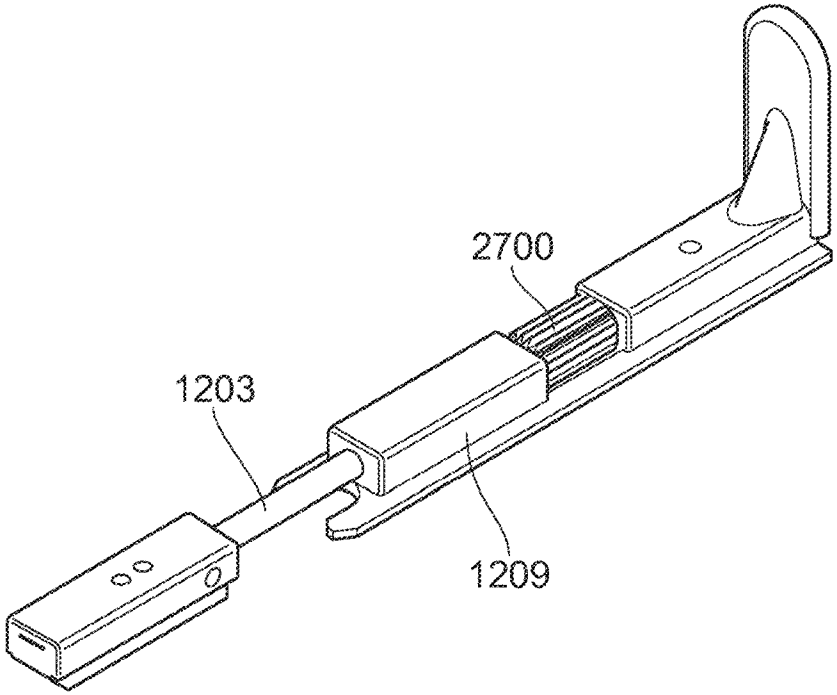
FIG. 27 is a schematic representation of an end of an actuation mechanism according to an example.

FIG. 27 is a schematic representation of the end of the actuation mechanism according to an example. The actuation mechanism in the example of FIG. 27 is similar to that of FIG. 26 but without the worm part. That is, a wheel portion 2700 is provided that can be rotated. Similarly to the mechanism as described with reference to FIG. 26, rotation of the wheel 2700 causes the length of the arm 1203 that protrudes from block to be modified.

Figure 28:
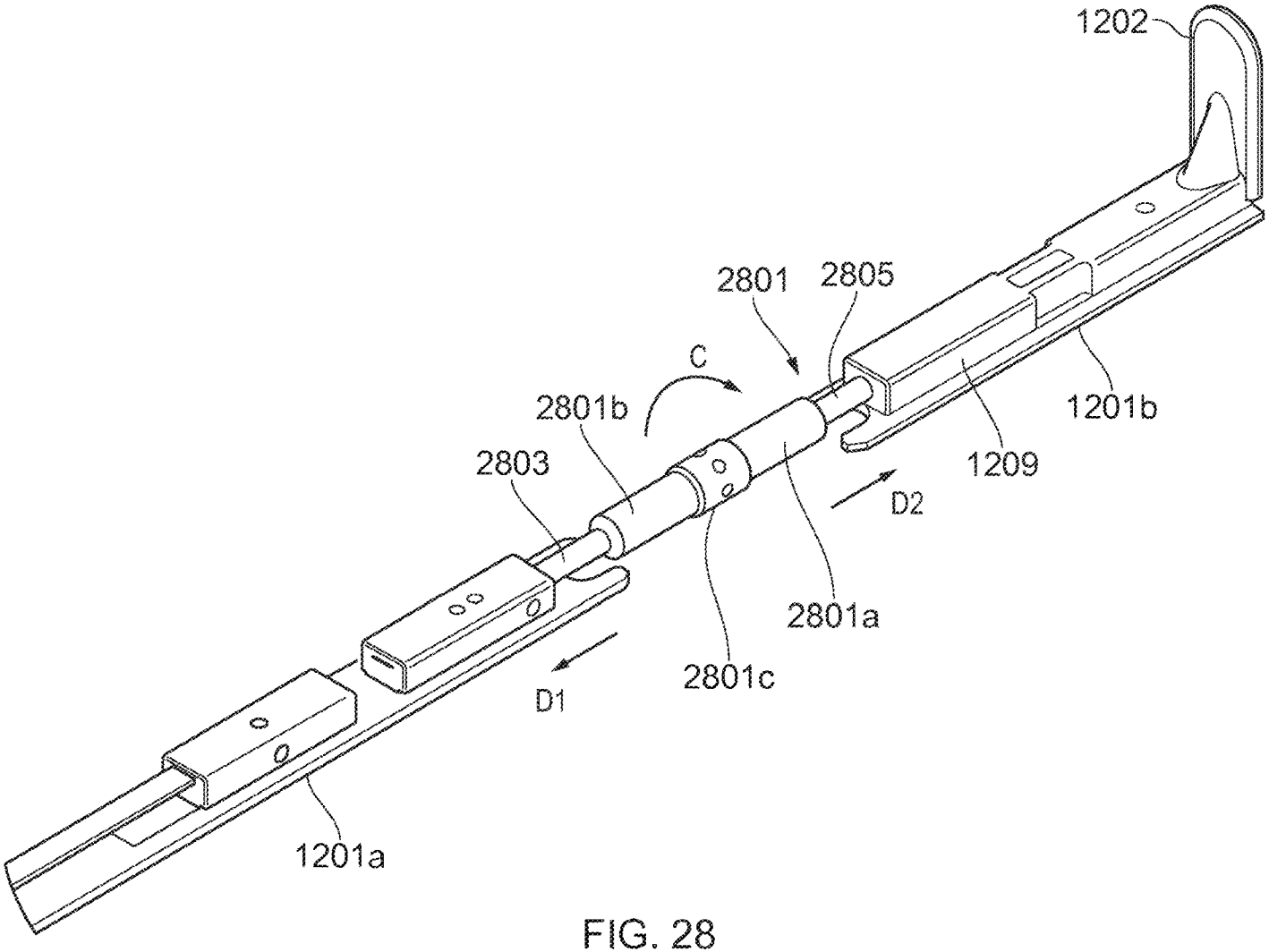
FIG. 28 is a schematic representation of an end of an actuation mechanism according to an example.

FIG. 28 is a schematic representation of the end of the actuation mechanism according to an example. The actuation mechanism in the example of FIG. 28 is in the form of a spline wheel 2801. The spline wheel 2801 comprises two internally threaded portions 2801*a* and 2801*b*. The internal screw threads of these portions are mirror images of one another. That is, rotation of the wheel 2800 in the direction C will cause movement of the arm portions 2803, 2805 in the directions D1 and D2 as shown. Rotation in the opposite direction causes movement of the arms the other way. More specifically, the ends of the arms 2803 and 2805 are configured to engage in the wheel 2801 and therefore comprise threaded portions that respectively correspond to the internal thread formations of the parts 2801*a* and 2801*b*. Due to the opposite nature of these thread formations with respect to one another, as the wheel 2801 is rotated, the arms will be moved away from one another or towards one another, depending on the direction of rotation of wheel 2801, thereby enabling the position of the two parts 1201*a* and 1201*b* to be modified.

Generally speaking therefore, there are multiple different ways in which the actuation mechanism can be adjusted in order to modify the degree to which a door seal rises from a threshold. Accordingly, the door catch (in the form of a vertical arm, and described as the thumb portion) can be moved either forwards or backwards in order to achieve the desired level of lift with the device.

In an example, the apparatus can be 'factory set' so that the thumb portion lies flush against the frame of a door in which it is installed. Accordingly, an installer can first assess that the subject door will in-fact close properly. Provided this check is positive, the thumb portion can be then wound into a forward position, forward of the door frame as to catch the door before it is fully closed and in a position where the desired amount of lift equals the gap below the door.

Figure 29:
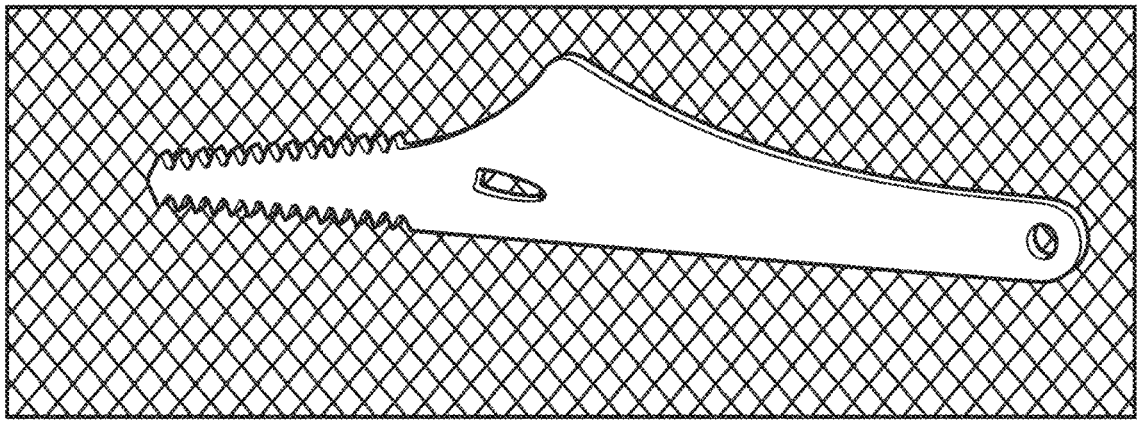
FIG. 29 is a schematic representation of a tool for adjusting a threshold seal apparatus according to an example.

FIG. 29 is a schematic representation of a tool for adjusting a threshold seal apparatus according to an example. The tool comprises a hand held tool that includes multiple teeth or a serrated portion that can be used to adjust a wheel, for example, such as a wheel of FIG. 27.

According to an example, there is provided a kit of parts, comprising a threshold seal apparatus as provided here, and a tool for adjusting the threshold seal apparatus. The components of the kit can be cut to length as required for the task at hand. For example, channel portions and so on can be cut to desired lengths in order to enable the apparatus to be fitted into a recess for a door threshold.

A method of installing a threshold seal can include providing a seal apparatus or a kit as provided herein, introducing the channel portion into a suitable recess in the threshold of a doorway in which the apparatus is to be installed, and adjusting the position of a thumb portion of the apparatus whereby to modify the displacement of the actuation mechanism so as to cause the seal to contact the underside of a door mounted within the doorway when the apparatus is actuated. By default, as noted above, the thumb portion can be provided so that it is initially flush with the edge of a door. The door can then be close to check that the apparatus does not impede the safe operation of the door. The thumb can then be adjusted in order to provide the desired level of lift for the seal to contact the underside of the door.

The present inventions can be embodied in other specific apparatus and/or methods. The described embodiments are to be considered in all respects as illustrative and not restrictive. In particular, the scope of the invention is indicated by the appended claims rather than by the description and figures herein. All changes that come within the meaning and range of equivalency of the claims are to be embraced within their scope. Although individual embodiments may be discussed it is intended that the invention can cover combinations of those embodiments or combinations of aspects thereof, including combinations of all features disclosed.

The invention claimed is:

1. A threshold seal apparatus for a doorway, the threshold seal apparatus comprising:

a floor-mountable channel portion;

a seal configured to be received within the channel portion; and an actuation mechanism operable to move the seal with respect to the channel portion between a retracted position and an extended position in which the seal is configured to contact an underside of a door mounted within the doorway, wherein the actuation mechanism comprises:

a slide bar comprising an arm configured to be slideably mounted in the channel portion, the arm including a substantially flat bar formed with a first aperture and a second aperture which is spaced apart from the first aperture and including a thumb portion at an end of the arm, the thumb portion configured to protrude substantially perpendicularly to a long axis of the arm from an end of the channel portion when the arm is in situ in the channel portion, and a first elongate leaf spring, wherein a first end of the first elongate leaf spring is fastened to a first mounting block integrally formed with a first foot, and a second, opposite end of the first elongate leaf spring is fastened to a second mounting block integrally formed with a second foot, the first mounting block being mounted in the first aperture of the flat bar and retained in the first aperture by the first foot which is shaped such that removal of the first mounting block from the first aperture in a vertical direction is prevented by the first foot of the first mounting block engaging with a portion of the flat bar defining the first aperture, and the second mounting block being mounted in the second aperture of the flat bar and retained in the second aperture by the second foot which is shaped such that removal of the second mounting block from the second aperture in the vertical direction is prevent by the second foot of the second mounting block engaging with a portion of the flat bar defining the second aperture, wherein, along the long axis of the arm, the second foot of the second mounting block has a length which is less than a length of the second aperture, and wherein the threshold seal apparatus further comprises a restricting mechanism configured to restrict a movement of the second mounting block relative to the channel portion to cause the second mounting block to slide within the second aperture as the slide bar is moved relative to the channel portion in a direction parallel to the long axis of the arm.

2. The threshold seal apparatus as claimed in claim 1, wherein the arm comprises first and second arm parts separated by a gap having a width which can be modified using an adjustment control structure.

3. The threshold seal apparatus as claimed in claim 2, further comprising an adjustment arm configured to link the first and second arm parts.

4. The threshold seal apparatus as claimed in claim 2, wherein the adjustment control structure is connected to the thumb portion.

5. The threshold seal apparatus as claimed in claim 1, wherein the restricting mechanism comprises a rollpin.

6. The threshold seal apparatus as claimed in claim 1, further comprising a second elongate leaf spring, wherein the flat bar is formed with a third aperture having a length along the long axis of the arm, wherein an end of the second elongate leaf spring is fastened to the flat bar, and a portion of the second elongate leaf spring is fastened to a third mounting block comprising a third foot, wherein, along the long axis of the arm, the third mounting block comprises a length which is less than the length of the third aperture, and wherein the third mounting block is slidably mounted in the third aperture and retained within the third aperture by the third foot which is shaped to engage with a portion of the flat bar defining the third aperture.

7. The threshold seal apparatus as claimed in claim 6, further comprising:

another restricting mechanism configured to limit a movement of the third mounting block relative to the channel portion in at least one direction as the slide bar is moved relative to the channel portion in the direction parallel to the longitudinal axis of the arm.

8. The threshold seal apparatus as claimed in claim 6, wherein the second elongate leaf spring is fixedly attached to a rail portion configured to receive the seal.

9. The threshold seal apparatus as claimed in claim 8, further comprising an interface between (i) the first elongate leaf spring or the second elongate leaf spring and (ii) the rail portion.

10. The threshold seal apparatus as claimed in claim 1, wherein the second end of the first elongate leaf spring is fastened directly to the second mounting block.

11. The threshold seal apparatus as claimed in claim 1, wherein the channel portion comprises a base with a pair of walls extending therefrom, each of the pair of walls including a lip configured to extend substantially perpendicularly from a respective one of the pair of walls and in an outward direction relative to a channel defined by the base and the pair of walls.

12. The threshold seal apparatus as claimed in claim 11, wherein the channel portion further comprises a pair of channel arms disposed within the channel, each of the pair of channel arms extending from a respective one of the pair of walls of the channel portion, the channel arms defining an internal channel within the channel portion configured to accommodate the mounting blocks and the arm.

13. A threshold seal apparatus for a doorway, the threshold seal apparatus comprising:

a floor-mountable channel portion;

a seal configured to be received within the channel portion; and an actuation mechanism operable to move the seal with respect to the channel portion between a retracted position and an extended position in which the seal is configured to contact an underside of a door mounted within the doorway, wherein the actuation mechanism comprises:

a slide bar comprising an arm configured to be slideably mounted in the channel portion, the arm being formed with an aperture and including a thumb portion at an end of the arm, the thumb portion configured to protrude substantially perpendicularly to a long axis of the arm from an end of the channel portion when the arm is in situ in the channel portion, and an elongate leaf spring, wherein a first end of the elongate leaf spring is fastened to the arm and a second, opposite end of the elongate leaf spring is fastened directly to a mounting block comprising a foot, the mounting block being mounted in the aperture and retained in the aperture by the foot which is shaped to engage with a portion of the arm defining the aperture, wherein, along the long axis of the arm, the foot of the mounting block has a length which is less than a length of the aperture, and the threshold seal apparatus further comprises a restricting mechanism configured to restrict a movement of the mounting block relative to the channel portion to cause the mounting block to slide within the aperture as the slide bar is moved relative to the channel portion in a direction parallel with the long axis of the arm.

* * * * *